US006773302B2

(12) United States Patent
Gutierrez et al.

(10) Patent No.: US 6,773,302 B2
(45) Date of Patent: Aug. 10, 2004

(54) ADVANCED MICROELECTRONIC CONNECTOR ASSEMBLY AND METHOD OF MANUFACTURING

(75) Inventors: Aurelio J. Gutierrez, Bonita, CA (US); Dallas A. Dean, Oceanside, CA (US)

(73) Assignee: Pulse Engineering, Inc., San Diego, CA (US)

( * ) Notice: Subject to any disclaimer, the term of this patent is extended or adjusted under 35 U.S.C. 154(b) by 14 days.

(21) Appl. No.: 10/099,645

(22) Filed: Mar. 14, 2002

(65) Prior Publication Data

US 2002/0160663 A1 Oct. 31, 2002

Related U.S. Application Data

(60) Provisional application No. 60/276,376, filed on Mar. 16, 2001.

(51) Int. Cl.[7] ..... H01R 13/66

(52) U.S. Cl. ..... 439/541.5; 439/620; 439/490; 439/941

(58) Field of Search ..... 439/676, 620, 439/939, 941, 490, 541.5

(56) References Cited

U.S. PATENT DOCUMENTS

| | | | | | |
|---|---|---|---|---|---|
| 4,274,691 | A | * | 6/1981 | Abernethy et al. | 439/507 |
| 4,726,638 | A | * | 2/1988 | Farrar et al. | 439/620 |
| 4,789,847 | A | * | 12/1988 | Sakamoto et al. | 333/185 |
| 4,799,901 | A | * | 1/1989 | Pirc | 439/620 |
| 5,587,884 | A | * | 12/1996 | Raman | 361/728 |
| 5,647,767 | A | | 7/1997 | Scheer et al. | |
| 5,697,817 | A | * | 12/1997 | Bouchan et al. | 439/676 |
| 5,736,910 | A | * | 4/1998 | Townsend et al. | 333/181 |
| 5,759,067 | A | * | 6/1998 | Scheer | 439/607 |
| 5,911,602 | A | | 6/1999 | Vaden | |
| 6,022,245 | A | | 2/2000 | Minich | |
| 6,080,011 | A | * | 6/2000 | Tsao et al. | 439/541.5 |
| 6,116,963 | A | | 9/2000 | Shutter | |
| 6,132,260 | A | * | 10/2000 | Wu | 439/676 |
| 6,193,560 | B1 | | 2/2001 | Morana et al. | |
| 6,227,905 | B1 | * | 5/2001 | Tsai et al. | 439/541.5 |
| 6,325,664 | B1 | | 12/2001 | Someda et al. | |
| 6,474,999 | B1 | * | 11/2002 | Givens et al. | 439/76.1 |
| 6,540,522 | B2 | * | 4/2003 | Sipe | 439/61 |
| 6,572,409 | B2 | * | 6/2003 | Nitta et al. | 430/608 |
| 6,602,095 | B2 | * | 8/2003 | Astbury et al. | 439/608 |

OTHER PUBLICATIONS

U.S. patent application Ser. No. 09/661,628, McWilliams et al., filed Sep. 13, 2000.

U.S. patent application Ser. No. 09/732,098, Gutierrez et al., filed Dec. 6, 2000.

* cited by examiner

*Primary Examiner*—Tho D. Ta
*Assistant Examiner*—Larisa Tsukerman
(74) *Attorney, Agent, or Firm*—Gazdzinski & Associates

(57) ABSTRACT

An advanced modular plug connector assembly incorporating a substrate disposed in the rear portion of the connector housing, the substrate adapted to receive one or more electronic components such as choke coils, transformers, or other signal conditioning elements or magnetics. In one embodiment, the connector assembly comprises a single port pair with a single substrate disposed in the rear portion of the housing. In another embodiment, the assembly comprises a multi-port "row-and-column" housing with multiple substrates (one per port) received within the rear of the housing, each substrate having signal conditioning electronics which condition the input signal received from the corresponding modular plug before egress from the connector assembly. In yet another embodiment, the connector assembly comprises a plurality of light sources (e.g., LEDs) received within the housing. Methods for manufacturing the aforementioned embodiments are also disclosed.

16 Claims, 19 Drawing Sheets

(SHEET 1 OF 3)

(SHEET 2 OF 3)

(SHEET 3 OF 3)

ADVANCED MICROELECTRONIC CONNECTOR ASSEMBLY AND METHOD OF MANUFACTURING

PRIORITY

This application claims priority benefit to U.S. provisional patent application Ser. No. 60/276,376 filed Mar. 16, 2001 entitled "Advanced Microelectronic Connector Assembly And Method Of Manufacturing" which is incorporated herein by reference in its entirety.

BACKGROUND OF THE INVENTION

1. Field of the Invention

The present invention relates generally to microminiature electronic elements and particularly to an improved design and method of manufacturing a single- or multi-connector assembly which may include internal electronic components.

2. Description of Related Technology

Existing modular jack/connector technology commonly utilizes individual discrete components such as choke coils, filters, resistors, capacitors, transformers, and LEDs disposed within the connector to provide the desired functionality. The use of the discrete components causes considerable difficulty in arranging a layout within the connector, especially when considering electrical performance criteria also required by the device. Often, one or more miniature printed circuit boards (PCBs) are used to arrange the components and provide for electrical interconnection there between. Such PCBs consume a significant amount of space in the connector, and hence must be disposed in the connector housing in an efficient fashion which does not compromise electrical performance, and which helps minimize the manufacturing cost of the connector. This is true in both single and multi-row connector configurations.

U.S. Pat. No. 5,759,067 entitled "Shielded Connector" to Scheer (hereinafter "Scheer") exemplifies a common prior art approach. In this configuration, one or more PCBs are disposed within the connector housing in a vertical planar orientation such that an inner face of the PCB is directed toward an interior of the assembly and an outer face directed toward an exterior of the assembly. This is best shown in FIGS. 1 and 2 of Scheer. The arrangement of Scheer, however, is not optimal from space usage and electrical performance standpoints, in that when the components are disposed on the PCBs on the inner face (see FIG. 6 of Scheer), they are in close proximity to the majority of run of the jack (and to some degree modular plug) conductors, thereby allowing for significant cross-talk and EMI opportunity there between.

Alternatively, if all or the preponderance of the components are disposed on the external or outward side of the vertical PCB (see, e.g., FIG. 4 of Scheer), significant space is wasted in the interior volume of the connector, thereby forcing the designer to either utilize smaller and/or fewer components in their design to fit within a prescribed housing profile, and/or utilize a larger housing or thinner walls to generate more interior volume. Stated differently, the ratio of usable volume to total volume within the connector is not optimized.

Based on the foregoing, it would be most desirable to provide an improved connector apparatus and method of manufacturing the same. Such improved apparatus would ideally be highly efficient at using the interior volume of the connector as compared to prior art solutions, mitigate cross-talk and EMI to a high degree, and allow for the use of a variety of different components (including light sources) within the connector assembly at once, thereby reducing labor cost.

SUMMARY OF THE INVENTION

In a first aspect of the invention, an improved connector assembly for use on, inter alia, a printed circuit board or other device is disclosed. The connector includes at least one substrate (e.g., circuit board) disposed in substantially vertical and orthogonal orientation to the front face of the connector. In one exemplary embodiment, the assembly comprises a connector housing having a single port pair (i.e., two modular plug recesses), a plurality of conductors disposed within the recesses for contact with the terminals of the modular plug, and at least one component substrate disposed in the rear portion of the housing, the component substrates having at least one electronic component disposed thereon and in the electrical pathway between the conductors and the corresponding circuit board leads. The substantially orthogonal orientation of the board(s) allows maximum space efficiency with minimal noise and cross-talk.

In a second exemplary embodiment, the assembly comprises a connector housing having a plurality of connector recesses arranged in port pairs, the recesses arranged in over-under and side-by-side orientation. A plurality of substrates arranged within each of the respective rear portions associated with each connector recess are also provided. The conductors associated with a first recess are disposed at their termination point on a first of the plurality of substrates, while the conductors associated with a second recess formed immediately over (or under) the first are disposed at their termination point on a second of the plurality of substrates, thereby allowing each of the respective recesses to have its own discrete substrate (optionally with electronic components thereon), and providing enhanced electrical separation, use of space within the connector, and ease of connector assembly.

In a second aspect of the invention, the connector assembly further includes a plurality of light sources (e.g., light-emitting diodes, or LEDs) adapted for viewing by an operator during operation. The light sources advantageously permit the operator to determine the status of each of the individual connectors simply by viewing the front of the assembly. In one exemplary embodiment, the connector assembly comprises a single recess (port) having two LEDs disposed relative to the recess and adjacent to the modular plug latch formed therein, such that the LEDs are readily viewable from the front of the connector assembly. The LED conductors (two per LED) are mated with the substrate(s) within the rear of the housing, and ultimately to the circuit board or other external device to which the connector assembly is mounted. In another embodiment, the LED conductors comprise continuous electrodes which terminate directly to the printed circuit board/external device. A multi-port embodiment having a plurality of modular plug recesses arranged in row-and-column fashion, and a pair of LEDs per recess, is also disclosed.

In another exemplary embodiment, the light sources comprise a "light pipe" arrangement wherein an optically conductive medium is used to transmit light of the desired wavelength(s) from a remote light source (e.g., LED) to the desired viewing location on the connector. In one variant, the light source comprises an LED which is disposed substantially on the substrate or device upon which the connector assembly is ultimately mounted, the location of the LED corresponding to a recess formed in the bottom portion of the connector, wherein the optically conductive medium receives light energy directly from the LED.

In a third aspect of the invention, an improved electronic assembly utilizing the aforementioned connector assembly is disclosed. In one exemplary embodiment, the electronic assembly comprises the foregoing connector assembly which is mounted to a printed circuit board (PCB) substrate having a plurality of conductive traces formed thereon, and bonded thereto using a soldering process, thereby forming a conductive pathway from the traces through the conductors of the respective connectors of the package. In another embodiment, the connector assembly is mounted on an intermediary substrate, the latter being mounted to a PCB or other component using a reduced footprint terminal array. An external noise shield is also optionally applied to mitigate external EMI.

In a fourth aspect of the invention, an improved method of manufacturing the connector assembly of the present invention is disclosed. The method generally comprises the steps of forming an assembly housing having at least one modular plug receiving recess and a rear cavity disposed therein; providing a plurality of conductors comprising a first set adapted for use within the recess of the housing element so as to mate with corresponding conductors of a modular plug; providing at least one substrate having at least one electrical pathway formed thereon, and adapted for receipt within the rear cavity; terminating one end of the conductors of the set to the substrate; providing a second set of conductors adapted for termination to the substrate and to the external device (e.g., circuit board) to which the connector will be mated; terminating the second set of conductors to the substrate, thereby forming an electrical pathway from the modular plug (when inserted in the recess) through at least one of the conductors of the first set to the distal end of at least one of the conductors of the second set; and inserting the assembled first conductors, substrate, and second conductors into the cavity within the housing. In another embodiment of the method, one or more electronic components are mounted on the substrate(s), thereby providing an electrical pathway from the modular plug terminals through the electronic component(s) to the distal ends of the second terminals.

BRIEF DESCRIPTION OF THE DRAWINGS

The features, objectives, and advantages of the invention will become more apparent from the detailed description set forth below when taken in conjunction with the drawings, wherein.

DETAILED DESCRIPTION OF THE PREFERRED EMBODIMENT

Reference is now made to the drawings wherein like numerals refer to like parts throughout.

It is noted that while the following description is cast primarily in terms of a plurality of RJ-type connectors and associated modular plugs of the type well known in the art, the present invention may be used in conjunction with any number of different connector types. Accordingly, the following discussion of the RJ connectors and plugs is merely exemplary of the broader concepts.

As used herein, the terms "electrical component" and "electronic component" are used interchangeably and refer to components adapted to provide some electrical function, including without limitation inductive reactors ("choke coils"), transformers, filters, gapped core toroids, inductors, capacitors, resistors, operational amplifiers, and diodes, whether discrete components or integrated circuits, whether alone or in combination, as well as more sophisticated integrated circuits such as SoC devices, ASICs, FPGAs, DSPs, etc. For example, the improved toroidal device disclosed in Assignee's co-pending U.S. patent application Ser. No. 09/661,628 entitled "Advanced Electronic Microminiature Coil and Method of Manufacturing" filed Sep. 3, 2000, which is incorporated herein by reference in its entirety, may be used in conjunction with the invention disclosed herein.

As used herein, the term "signal conditioning" or "conditioning" shall be understood to include, but not be limited to, signal voltage transformation, filtering, current limiting, sampling, processing, and time delay.

As used herein, the term "port pair" refers to an upper and lower modular connector (port) which are in a substantially over-under arrangement; i.e., one port disposed substantially atop the other port.

Single Port Pair Embodiment

Figure 1B:
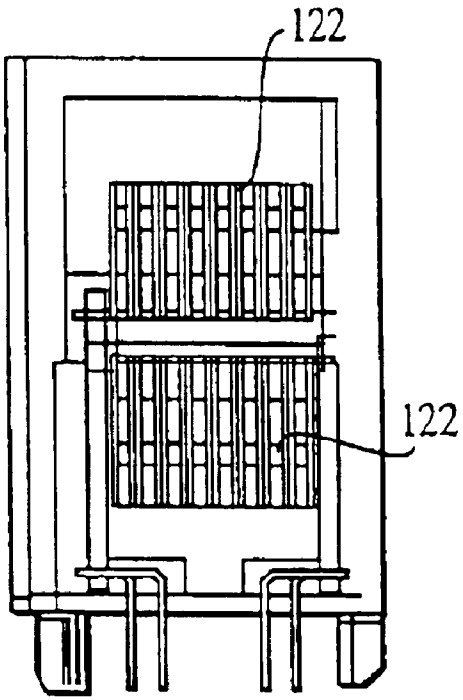
FIG. 1*b* is a rear plan view of the connector assembly according to FIG. 1*a*.
Figure 1A:
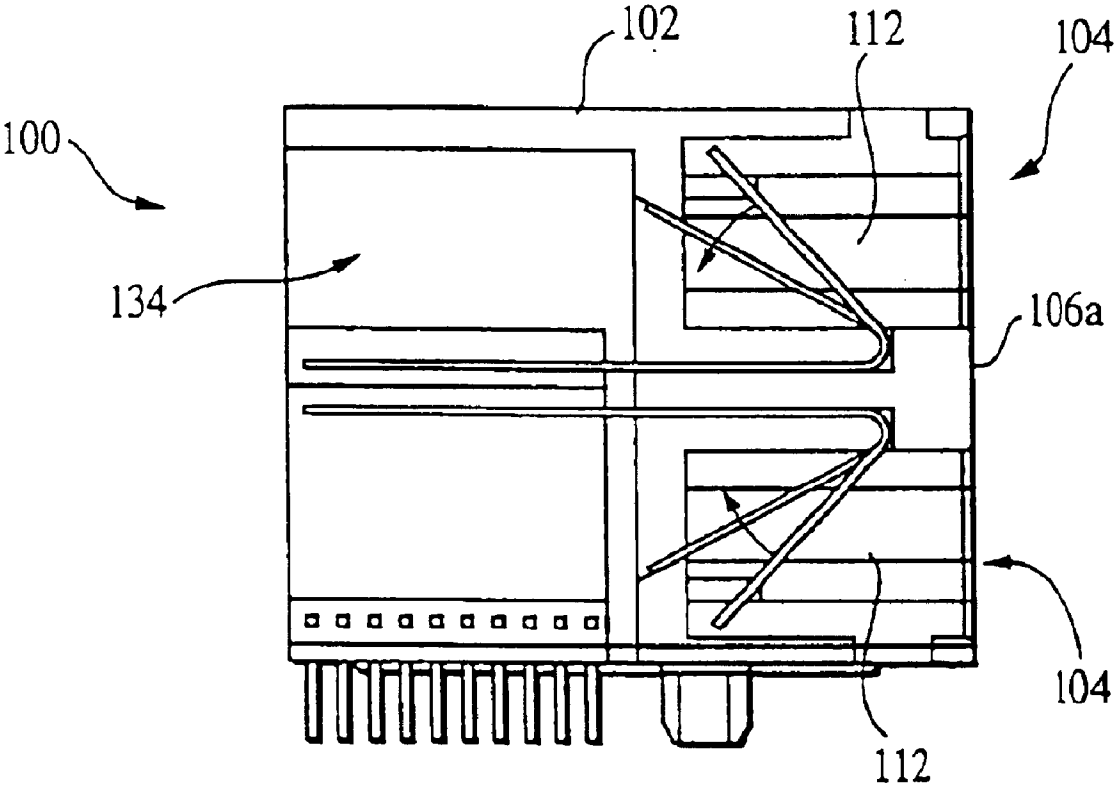
FIG. 1*a* is a side cross-sectional view of a first exemplary embodiment (single port pair) of the connector assembly according to the present invention, taken along a line running front-to-back on the connector body.
Figure 1C:
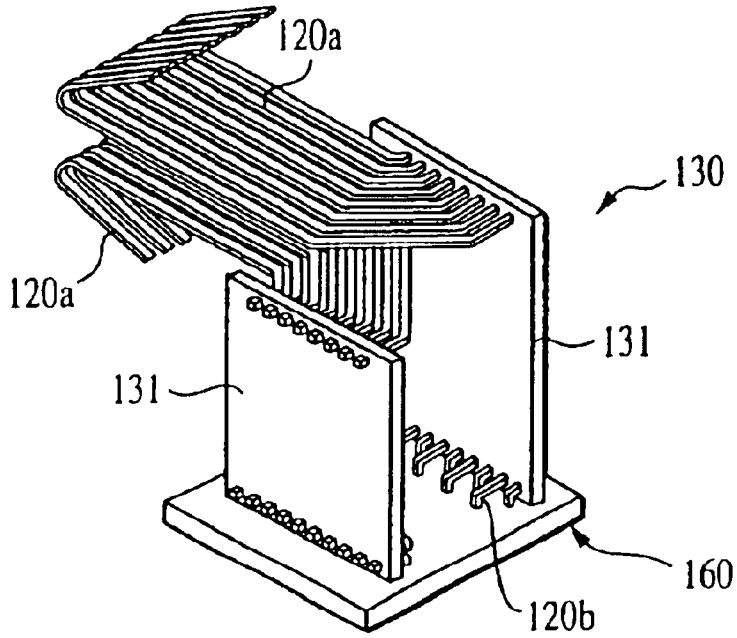
FIG. 1*c* is a perspective view of the primary substrate assemblies (less electronic components and/or conductive traces) used in the embodiment of FIGS. 1*a* and 1*b*.

Referring now to FIGS. 1*a*–1*c*, a first embodiment of the connector assembly of the present invention is described. As shown in FIGS. 1*a*–1*c*, the assembly 100 generally comprises a connector housing element 102 having two modular plug-receiving connectors 104 formed therein. The front wall 106*a* of the connectors 104 is further disposed generally perpendicular or orthogonal to the PCB surface (or other device) to which the connector assembly 100 is mounted, with the latch mechanism located away from the PCB, such that modular plugs may be inserted into the plug recesses 112 formed in the connectors 104 without physical interference with the PCB. The plug recesses 112 are adapted to each receive one modular plug (not shown) having a plurality of electrical conductors disposed therein in a predetermined array, the array being so adapted to mate with respective conductors 120*a* present in the recesses 112 thereby forming an electrical connection between the plug conductors and connector conductors 120*a*, as described in greater detail below. The connector housing element 102 is in the illustrated embodiment electrically non-conductive and is formed from a thermoplastic (e.g. PCT Thermex, IR compatible, UL94V- 0), although it will recognized that other materials, polymer or otherwise, may conceivably be used. An injection molding process is used to form the housing element 102, although other processes may be used, depending on the material chosen. The selection and manufacture of the housing element is well understood in the art, and accordingly will not be described further herein.

Also formed generally within each recess 112 in the housing element 102 are a plurality of grooves 122 which are disposed generally parallel and oriented substantially horizontally within the housing 102. The grooves 122 are spaced and adapted to guide and receive the aforementioned conductors 120 used to mate with the conductors of the respective modular plug. The conductors 120 are formed in a predetermined shape and held within an electronic component substrate assembly 130 (see FIG. 1*c*), the latter also mating with the housing element 102 as shown in FIG. 1*b*. Specifically, the housing element 102 includes a cavity 134 formed in the back of the connector 104 generally adjacent to the rear wall, the cavity 134 being adapted to receive the component substrate assemblies 130 in a substantially vertical orientation, with the plane of the primary substrate 131 being substantially parallel with the direction of run of the primary conductors 120*a* (i.e., front-to-back). The cavity 134 is also sized in depth by approximately the width of the primary substrate 131 such that the substrate assembly sits somewhat off-center. The first conductors 120*a* of the substrate/component assembly 130 are deformed such that when the assembly 130 is inserted into its cavity 134, the upper conductors 120*a* are received within the grooves 122, maintained in position to mate with the conductors of the modular plug when the latter is received within the plug recess 112. Second conductors 120*b* are also provided formatting to the PCB. The offset position of the substrate 131 allows any electrical components disposed thereon to fit entirely within the cavity 134, thereby allowing for a "standard" connector housing profile, and further allows the simultaneous placement of two assemblies 130 within the housing at the same time (including the electrical components associated with each, if provided), one for the upper connector, and one for the lower connector. Note, however, that electrical components may be disposed on either or both sides of the primary substrates 131 if desired, consistent with available room in the housing cavity (see, e.g., FIGS. 2*d*–2*f*). For example, in one exemplary embodiment, the electrical components mounted on each primary substrate are divided into two general groups for purposes of electrical isolation; e.g., resistors and capacitors are disposed on one side of the primary substrate, while the magnetics (e.g., choke coils, toroid core transformers, etc) are disposed on the other side of the primary substrate. The electrical components are further encapsulated in silicon or similar encapsulant for both mechanical stability and electrical isolation.

Figure 1D:
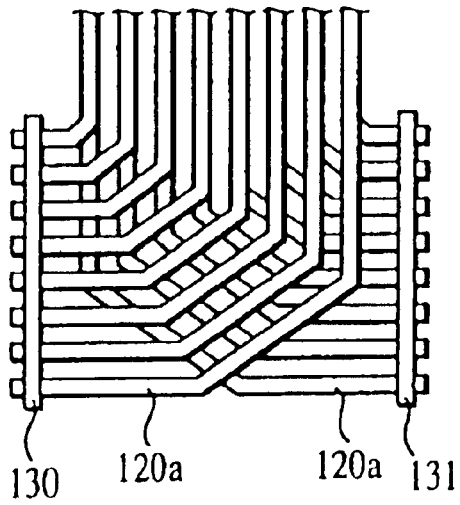
FIG. 1*d* is a top plan view of the first conductors of the connector assembly of FIG. 1*a*, illustrating the substantial non-overlap of the first conductor run.

One advantageous feature of the arrangement of the first conductors 120*a* of the respective substrates is that a significant portion of each first conductor is not in proximity and does not "overlap" with the corresponding first conductor of the other substrate in the port pair, as shown in FIG. 1*d*. Specifically, when viewed from directly above, significant portions of each conductor's run does not overlap with that of its corresponding conductor on the other substrate 131. This pattern as shown in FIG. 1*d* provides enhanced electrical separation, especially since it helps to avoid almost completely parallel straight runs of conductors as in Scheer previously described herein.

It will be recognized that while the embodiment of FIGS. 1*a*–1*c* includes a single port pair (i.e., two modular jacks), the invention may be practiced if desired with only one modular port, and one associated set of first and second conductors, primary substrate, etc. In such case, a single primary substrate and components disposed thereon would be disposed within the connector cavity, the primary substrate being offset from the fore-to-aft centerline of the port so as to accommodate the maximum amount of components possible. Such a single-port device may be used, for example, where a large amount (volumetrically) of signal conditioning electronics is required in support of a single port, or where the modular plug recess must be substantially elevated above the PCB or other device to which the connector assembly is mounted. Typically, however, it is anticipated that the port paired embodiments (such as those of FIGS. 1*a*–1*c* and 2*a*–2*g*) will be utilized.

Multi-Port Embodiment

Figure 2A:
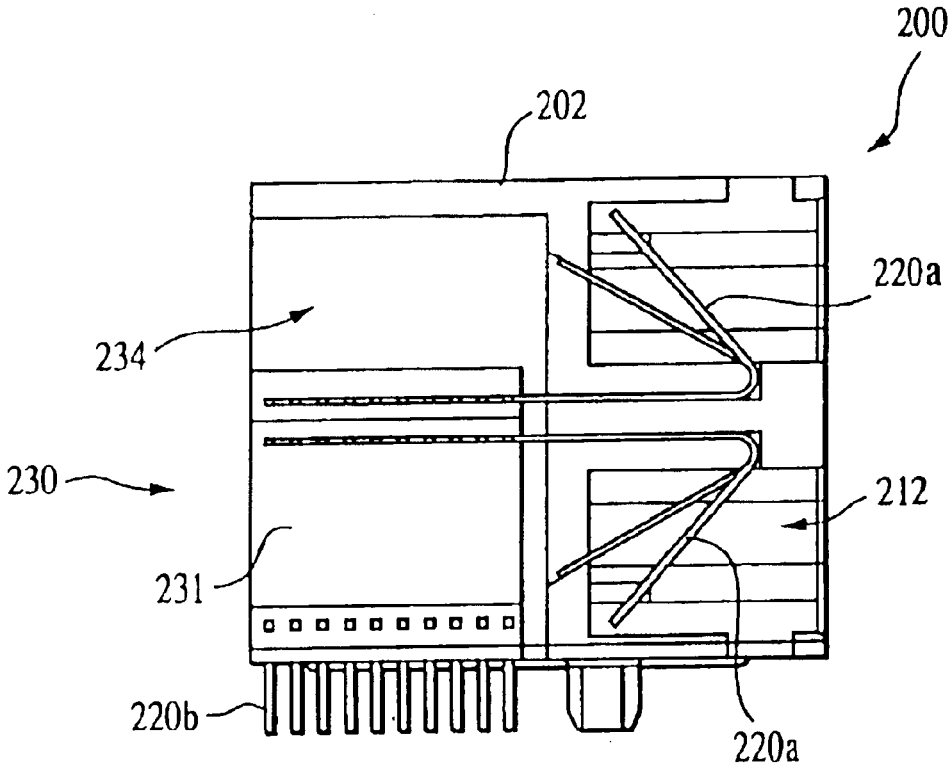
FIG. 2*a* is a side cross-sectional view of a second exemplary embodiment (multiport pairs) of the connector assembly according to the present invention.
Figure 2B:
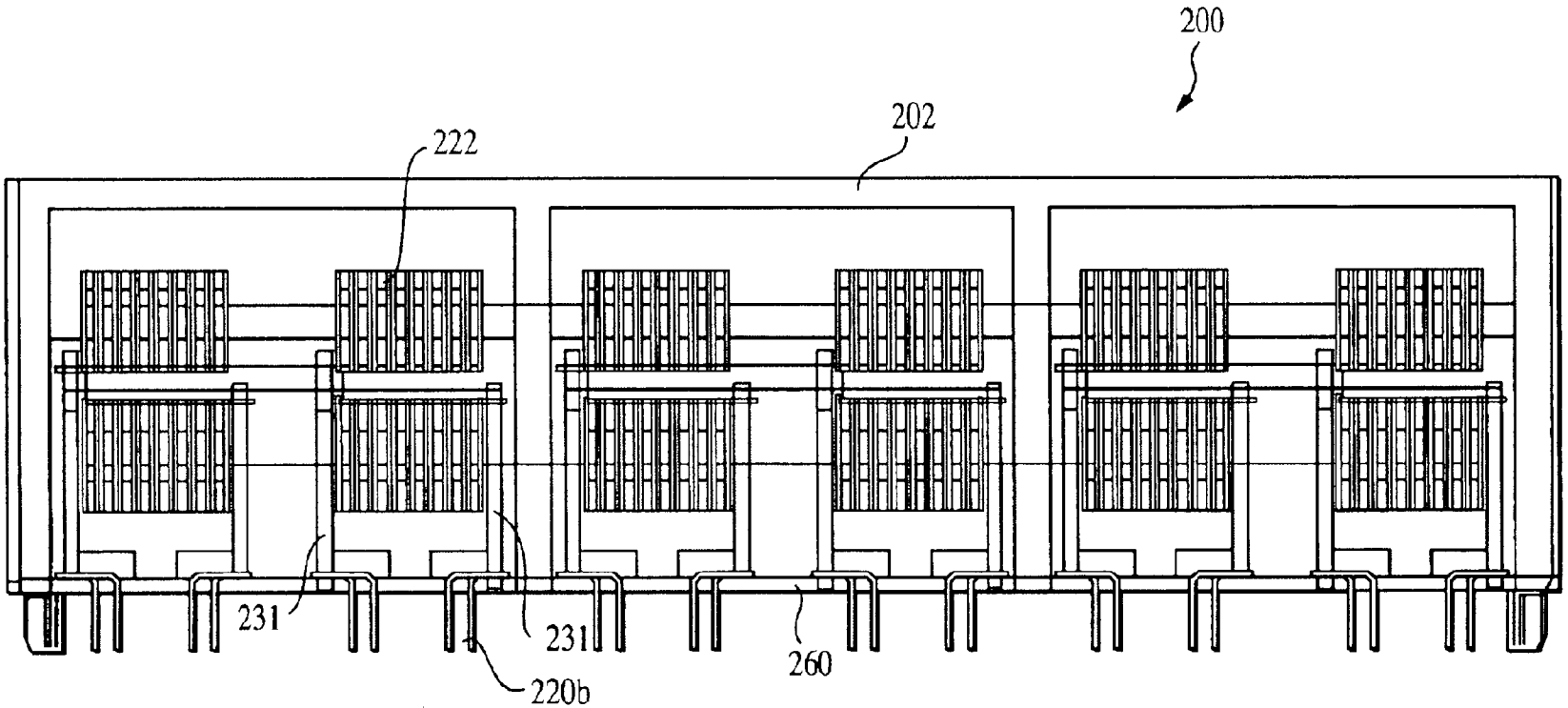
FIG. 2*b* is a rear plan view of the connector assembly according to FIG. 2*a*, showing various port pairs in various stages of assembly.
Figure 2C:
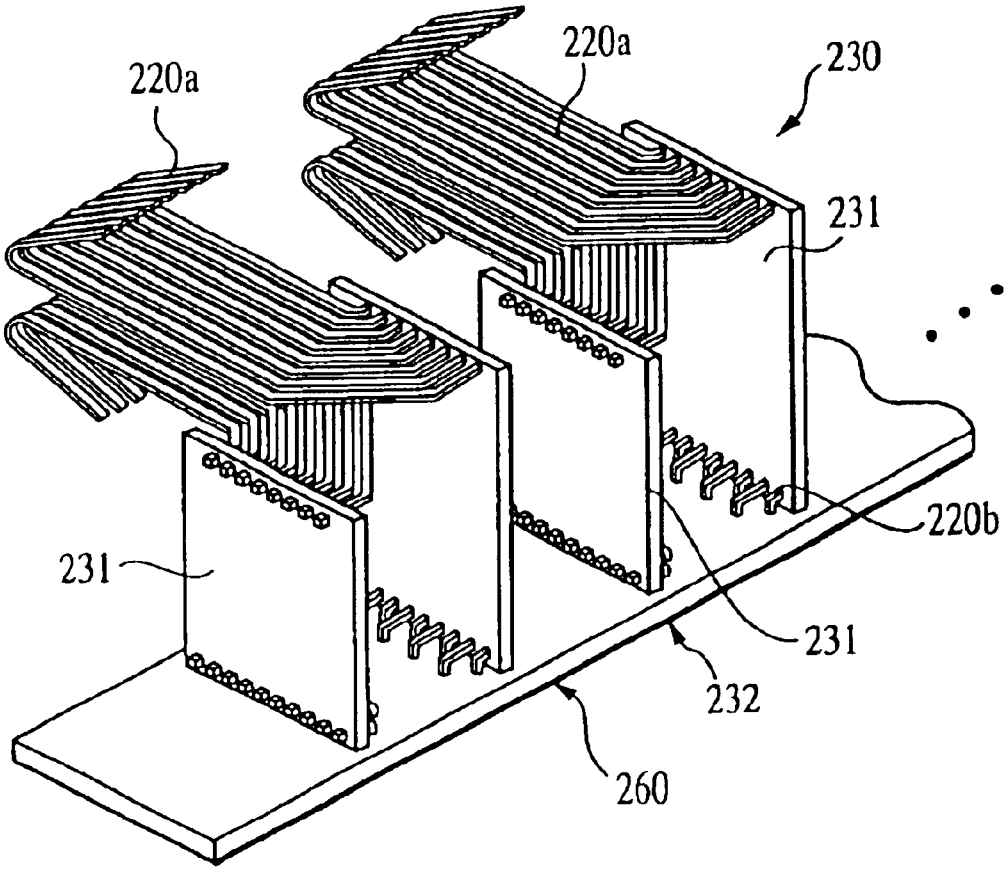
FIG. 2*c* is a perspective view of the primary substrate assemblies (less electronic components and/or conductive traces) used in the embodiment of FIGS. 2*a* and 2*b*.

Referring now to FIGS. 2*a*–2*c*, a second embodiment of the connector assembly of the present invention is described. As shown in FIGS. 2*a*–2*c*, the assembly 200 generally comprises a connector housing element 202 having a plurality of individual connectors 204 formed therein. Specifically, the connectors 204 are arranged in the illustrated embodiment in side-by-side row fashion within the housing 202 such that two rows 208, 210 of connectors 204 are formed, one disposed atop the other ("row-and-column"). The front walls 206*a* of each individual connector 204 are further disposed parallel to one another and generally coplanar, such that modular plugs (FIG. 2*a*) may be inserted into the plug recesses 212 formed in each connector 204 simultaneously without physical interference. The plug recesses 212 are each adapted to receive one modular plug (not shown) having a plurality of electrical conductors disposed therein in a predetermined array, the array being so adapted to mate with respective conductors 220*a* present in each of the recesses 212 thereby forming an electrical connection between the plug conductors and connector conductors 220*a*, as described in greater detail below.

As in the embodiment of FIGS. 1*a*–1*c* above, a plurality of grooves 222 which are disposed generally parallel and oriented vertically within the housing 202 are formed generally within the recess 212 of each connector 204 in the housing element 202. The grooves 222 are spaced and adapted to guide and receive the aforementioned conductors 220 used to mate with the conductors 216 of the modular plug. The conductors 220 are formed in a predetermined shape and held within one of a plurality (e.g., two) of electronic component substrate assemblies 230, 232 (FIG. 2*c*), the latter also mating with the housing element 202 as shown in FIG. 2*b*. Specifically, the housing element 202 includes a plurality of cavities 234 formed in the back of respective connectors 204 generally adjacent to the rear wall of each connector 204, each cavity 234 being adapted to receive the component substrate assemblies 230, 232 in tandem, complementary fashion. The cavities 234 are also sized in depth by approximately the width of the two primary substrates 231 such that the substrate assemblies sit in side-by-side arrangement, the left-hand assembly 232 (as viewed from the rear of the connector assembly housing 202) providing the first conductors 220*a* to the upper row port, and the right-hand assembly 230 providing the first conductors to bottom row port for the same port pair. The first conductors 220*a* of the substrate/component assemblies 230, 232 are deformed such that when the assemblies 230, 232 is inserted into its respective cavity 234, the upper conductors 220*a* are received within the grooves 222, maintained in position to mate with the conductors of the modular plug when the latter is received within the plug recess 212, and also maintained in electrical separation by the separators 223 disposed between and defining the grooves 222. When installed, the respective primary substrates are in a substantially vertical alignment, and are oriented "face to face" such that the components on each respective substrate are disposed within the cavity for that port pair (see FIG. 2*b*).

The substrate assemblies 230, 232 are retained within their cavities 234 substantially by way of friction with the housing element 202 and the capture of the second (lower) conductors 220*b* by the secondary substrate (described below), although other methods and arrangements may be substituted with equal success. The illustrated approach allows for easy insertion of the completed substrate assemblies 230, 232 into the housing 202, and subsequent selective removal if desired.

It will also be recognized that positioning or retaining elements (e.g., "contour" elements, as described in U.S. Pat. No. 6,116,963 entitled "Two Piece Microelectronic Connector and Method" issued Sep. 12, 2000, assigned to the Assignee hereof), and incorporated herein by reference in its entirety, may optionally be utilized as part of the housing element 202 of the present invention. These positioning or retaining elements are used, inter alia, to position the individual first conductors 220*a* with respect to the modular plug(s) received within the recess(es), and thereby provide a mechanical pivot point or fulcrum for the first conductors 220*a*. Additionally or in the alternative, these elements may act as retaining devices for the conductors 220*a* and its associated primary substrate 231 thereby providing a frictional retaining force which opposes removal of the substrate 231 and conductors from the housing 202. FIG. 2*h* illustrates the use of such contour elements within an exemplary connector body. The construction of such elements is well known in the art, and accordingly not described further herein.

In the illustrated embodiment of FIGS. 2*a*–2*c*, the two rows of connectors 208, 210 are disposed relative to one another such that the upper conductors 220*a* of the packages 230 associated with the top row 208 are slightly different in shape and length than those associated with the packages 232 for the bottom row 210. This difference in shape and length is largely an artifact of having the distal ends 229 of the upper conductors 220*a* mate with equivalent locations on the tandem substrate assemblies 230, 232.

Also in the illustrated embodiment, the first (upper) conductors 220*a* of each substrate assembly 230, 232 are displaced away from each other after egress from the separator element 223 to minimize electrical coupling and "cross-talk" there between. Specifically, as the length of the upper conductors 220*a* grows longer, the associated capacitance also increases, and hence the opportunity for cross-talk. The displacement of the first conductors 220*a* from each other in the present invention adds more distance between the conductors of that port pair, thereby reducing the field strength and accordingly the cross-talk there between.

In another variant of the embodiment of FIGS. 2*a*–2*c* (not shown), the upper conductors 220*a* are fashioned such that at least a portion of the conductors (e.g., two of the eight total in the embodiment of FIGS. 2*a*–2*c*) are displaced in the vertical direction for at least a portion of their run, thereby minimizing "crosstalk" as is well known in the electrical arts. Such displaced conductors may be contiguous (e.g., the two adjacent conductors at either edge 270 of the conductor set), or non-contiguous (e.g., one conductor at either edge, one conductor at one edge, and one non-edge conductor, etc.) as required by the particular application.

It is further noted that while the embodiment of FIGS. 2*a*–2*c* comprises two rows 208, 210 of six connectors 204 each (thereby forming a 2 by 6 array of connectors), other array configurations may be used. For example, a 2 by 2 array comprising two rows of two connectors each could be substituted. Alternatively, a 2 by 8 arrangement could be used. As another alternative, three rows of four connectors per row (i.e., 3 by 4) may be used. As yet another alternative, an asymmetric arrangement may be used, such as by having two rows with an unequal number of connectors in each row (e.g., two connectors in the top row, and four connectors in the bottom row). The modular plug recesses 212 (and front faces 206*a*) of each connector also need not necessarily be coplanar as in the embodiment of FIGS. 2*a*–2*c*. Furthermore, certain connectors in the array need not have primary substrates/electronic components, or alternatively may have components disposed on the primary substrates different than those for other connectors in the same array.

As yet another alternative, the connector configurations within the connector housing may be heterogeneous or hybridized. For example, one or more of the upper/lower row port pairs may utilize configurations which are different, such as the use of the substantially vertical complementary primary substrate pairs as described above with respect to FIG. 2 for some port pairs, and the use of the component package (e.g., interlock base) configuration described in U.S. Pat. No. 6,193,560 entitled "Connector Assembly with Side-by-Side Terminal Arrays" issued Feb. 27, 2001, co-owed by the Assignee hereof and incorporated herein by reference in its entirety, for other port pairs.

Many other permutations are possible consistent with the invention; hence, the embodiments shown herein are merely illustrative of the broader concept.

The rows 208, 210 of the embodiment of FIGS. 1*a*–1*c* and 2*a*–2*c* are oriented in mirror-image fashion, such that the latching mechanism 250 for each connector 204 in the top row 208 is reversed or mirror-imaged from that of its corresponding connector in the bottom row 210. This approach allows the user to access the latching mechanism 250 (in this case, a flexible tab and recess arrangement of the type commonly used on RJ modular jacks, although other types may be substituted) of both rows 208, 210 with the minimal degree of physical interference. It will be recognized, however, that the connectors within the top and bottom rows 208, 210 may be oriented identically with respect to their latching mechanisms 250, such as having all the latches of both rows of connectors disposed at the top of the plug recess 212, if desired.

Figure 4:
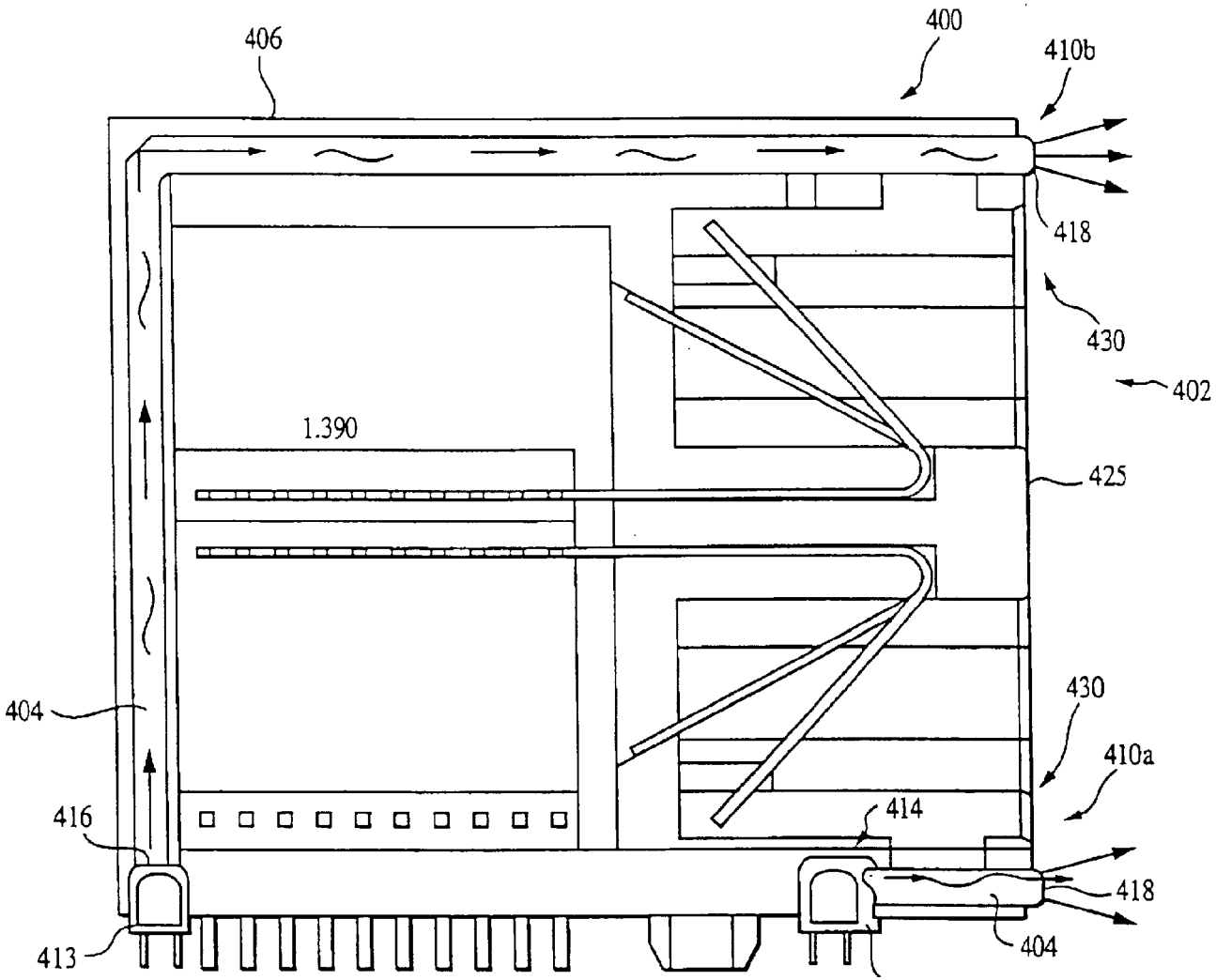
FIG. 4 is a side cross-sectional view of another embodiment of the connector of the invention, the connector including a plurality of light pipes and associated light sources.

The connector assembly 200 of the invention further comprises a single secondary substrate 260 which is disposed in the illustrated embodiment on the bottom face of the connector assembly 200 adjacent to the PCB or external device to which the assembly 100 is ultimately mounted (FIG. 4). The substrate comprises, in the illustrated embodiment, at least one layer of fiberglass 262, although other arrangements and materials may be used. The substrate 260 further includes a plurality of conductor perforation arrays 268 formed at predetermined locations on the substrate 260 with respect to the second (lower) conductors 220*b* of each primary substrate assembly 230 such that when the connector assembly 100 is fully assembled, the second conductors 220*b* penetrate the substrate 260 via respective ones of the aperture arrays 268. This arrangement advantageously provides mechanical stability and registration for the lower conductors 220*b*.

Figure 2D:
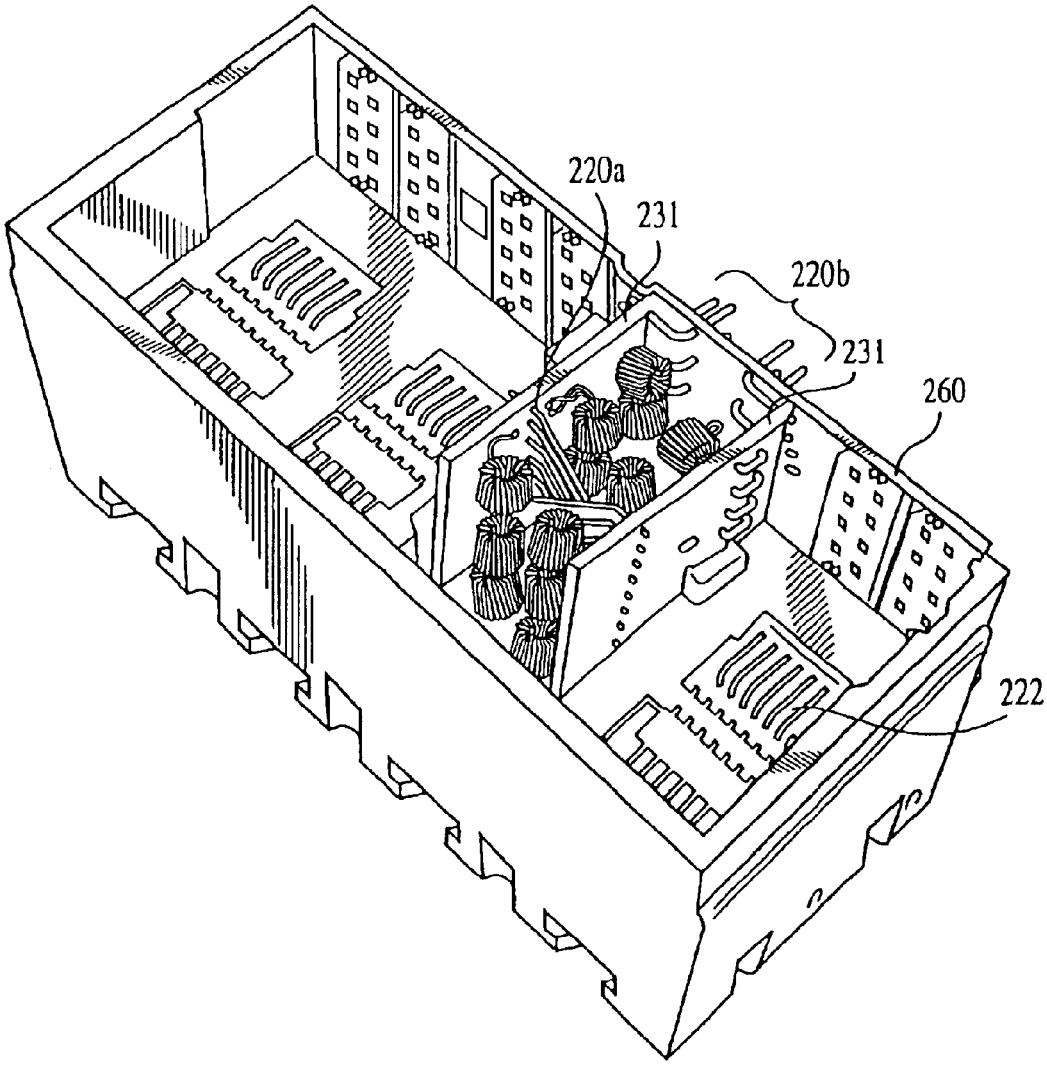
FIGS. 2*d*–2*f* are various perspective views of the embodiment of FIGS. 2*a*–2*c*, illustrating the assembled device and subcomponents thereof.
Figure 2E:
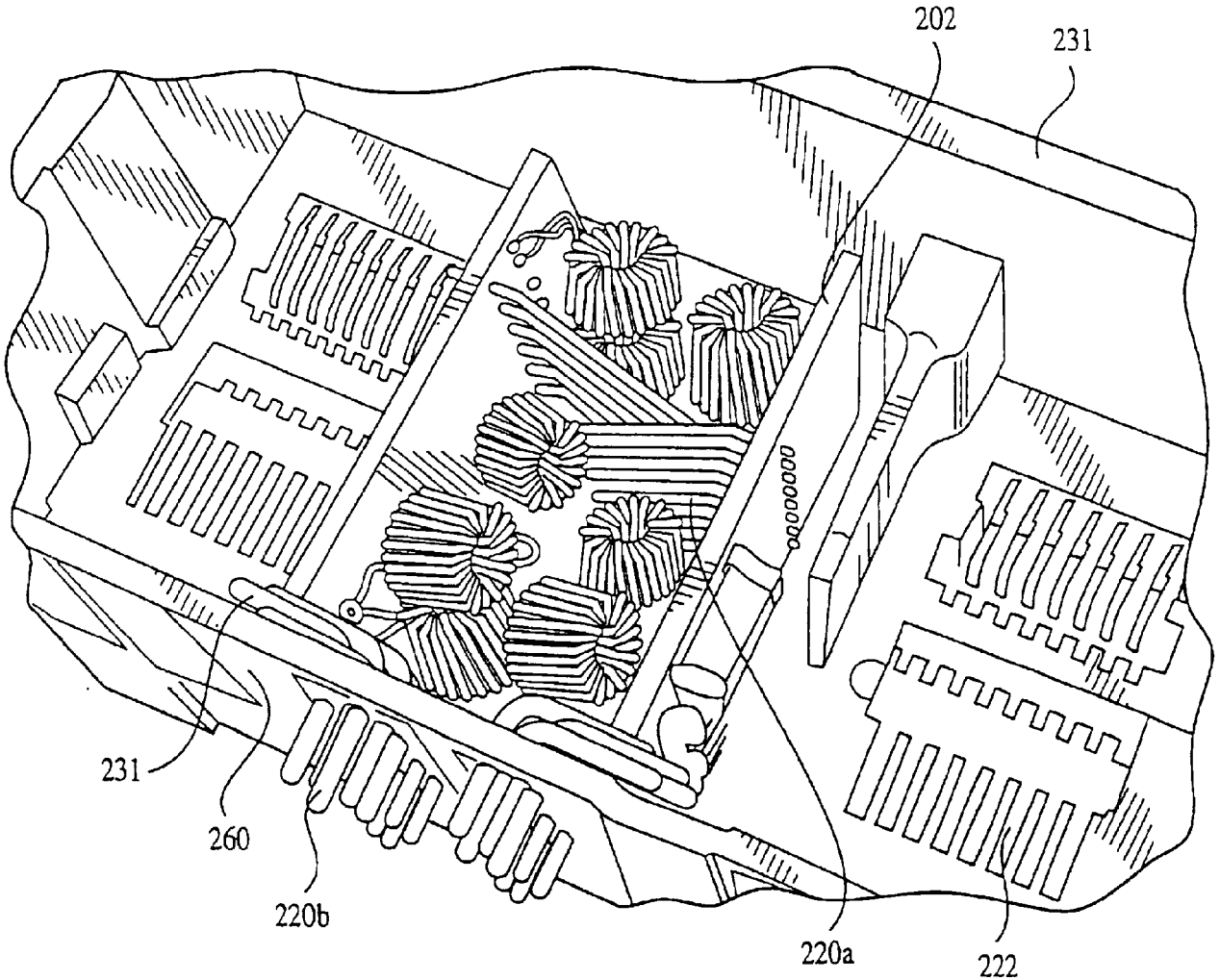
Figure 2F:
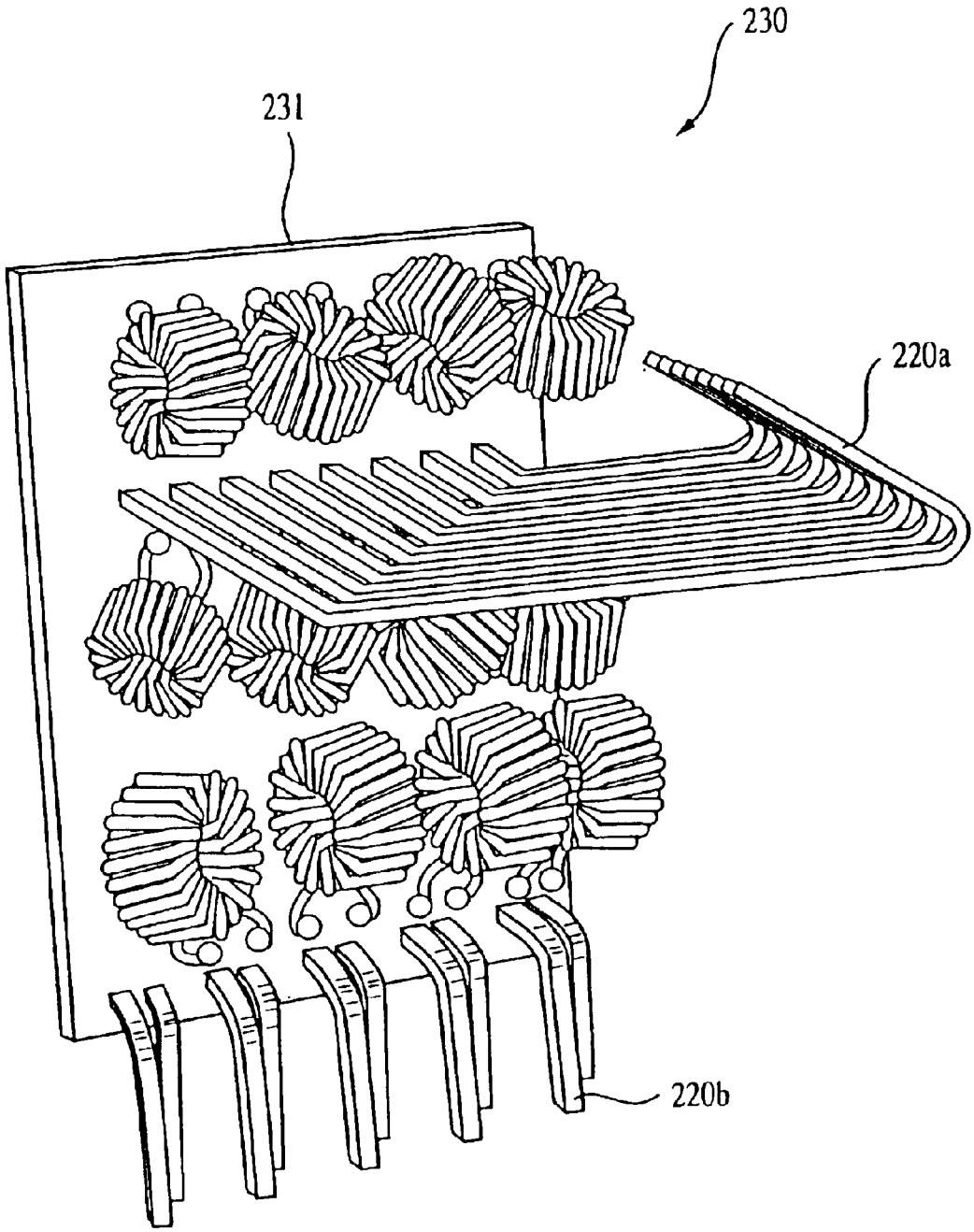

FIG. 2*d*–2*f* illustrates various aspects of the connector of FIGS. 2*a*–2*c*, as assembled in a working device.

Figure 2G:
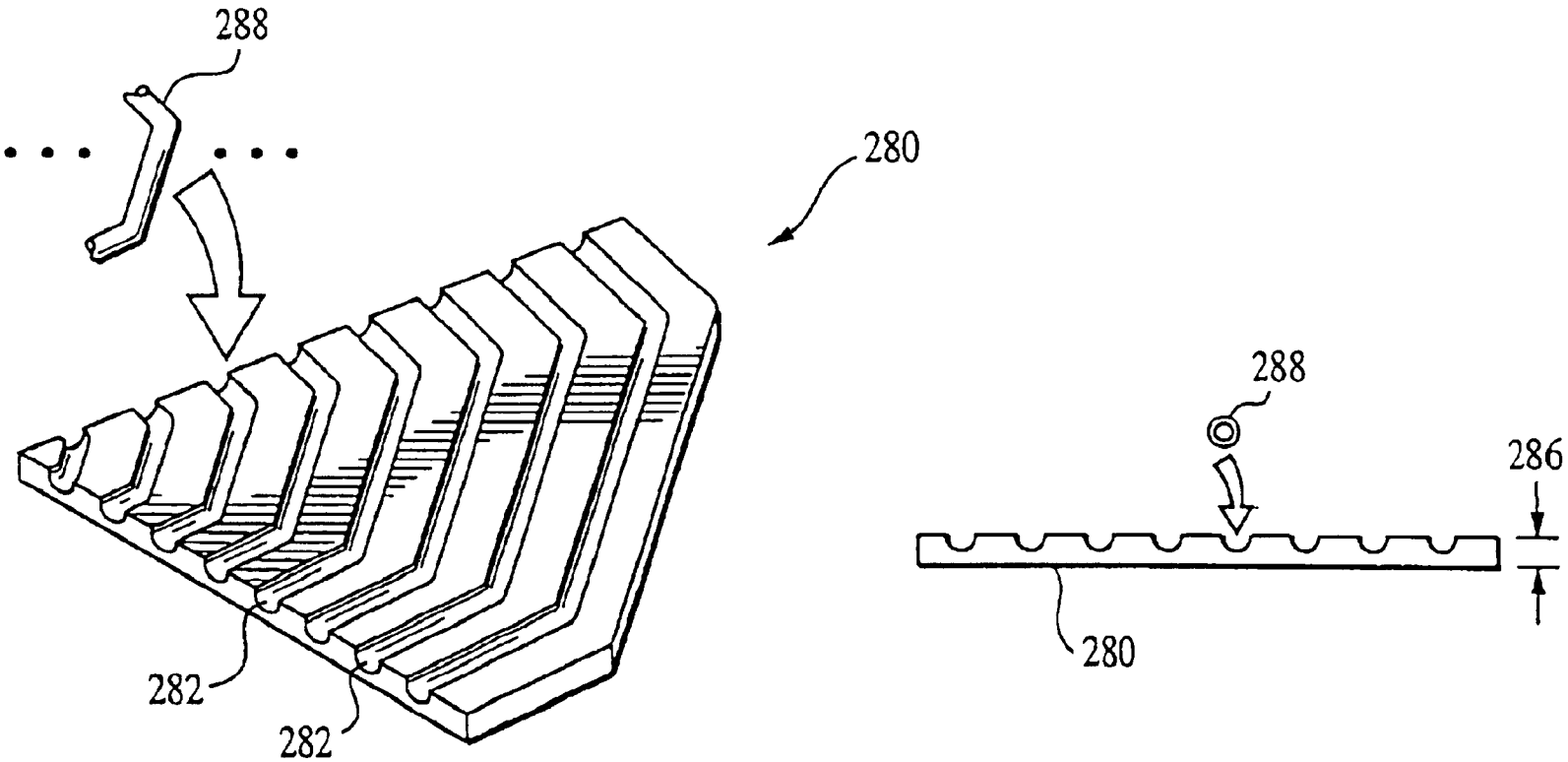
FIG. 2*g* is a perspective view of one embodiment of the conductor carrier optionally used in conjunction with the upper conductors of the connector of FIGS. 1–2*g*.
Figure 2H:
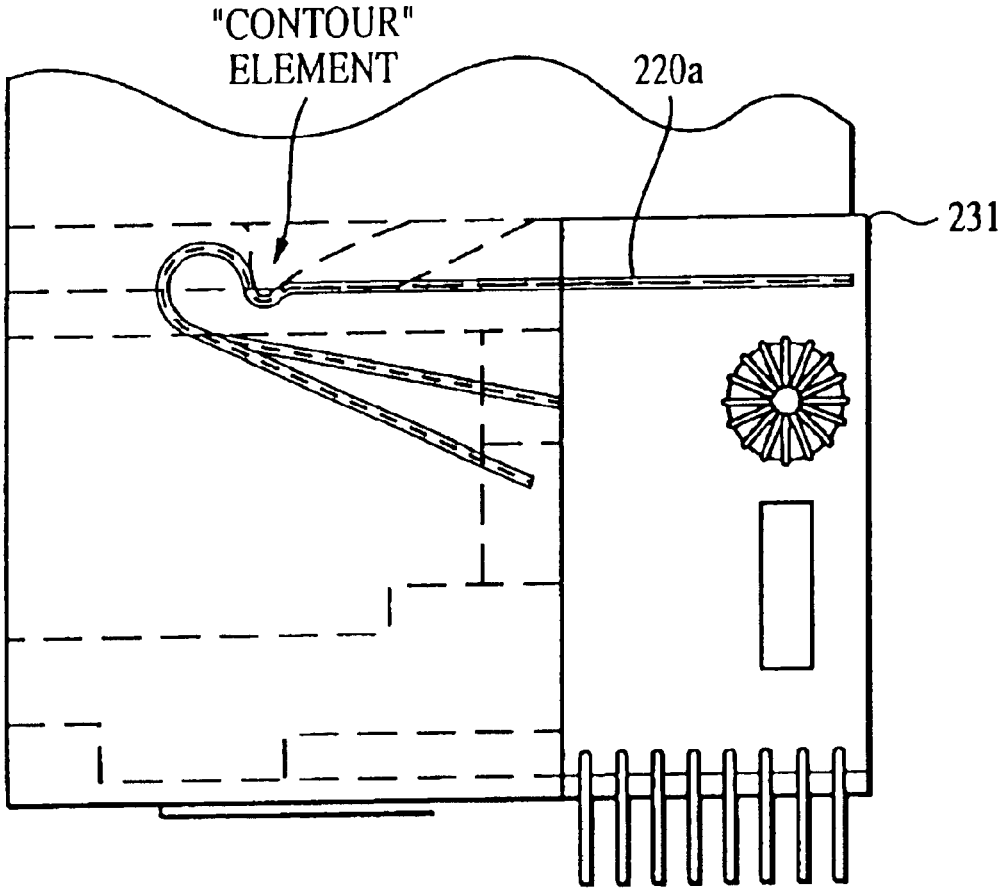
FIG. 2*h* is side cross-sectional view of an exemplary embodiment of the connector of the invention with contour elements.

Referring now to FIG. 2*g*, one exemplary embodiment of a conductor carrier device optionally used with the connector assemblies of FIGS. 1–2*g* above is described. As shown in FIG. 2*g*, the carrier 280 comprises a molded (e.g., polymer) "clip" which has a plurality of substantially aligned grooves 282 formed on one side thereof. The grooves 282 are sized and spaced so as to generally coincide with that portion of the first or upper conductors 220*a* for the insert assembly with which the carrier 280 is associated, the conductors 220*a* being received in respective ones of said grooves 282. In one variant, each of the conductors 220*a* is frictionally received within its respective groove, thereby maintaining the relative positions of the conductors and the carrier 280, although it will be recognized that the adhesives or other means may be used to retain at least a portion of the conductors within their respective grooves. In another variant, the carrier assembly is comprised of two half-pieces which fit together (e.g., snap-fit) around the conductors. It will be recognized that yet other approaches may be used, such as for example molding of the carrier onto the conductors after the latter have been formed to the desired shape and/or installed in the desired orientation within the insert assembly, or alternatively molding the carrier assembly, and routing the conductors through apertures formed in the carrier, thereby deforming them at least in part.

The carrier of FIG. 2*g* is generally planar in profile such that it receives conductors in generally side-by-side fashion, yet does not significantly increase the effective height 286 of the combined conductors and carrier. This "low profile" of the carrier 280 reduces the space required thereby within the cavity of the connector housing, thereby allowing more room for other components, as well as providing electrical separation between (i) the individual conductors 220*a* in a given set, and (ii) the conductors 220*a* of the two sets associated with each of the connectors in a port pair. It also allows the thickness of the carrier to be adjusted to help maintain a desired vertical spacing between the first conductors of the two connectors in a port pair. The carrier 280 is also ideally shaped such that it accommodates the desired portion 288 of the conductors 220*a* without requiring significant additional area; i.e., its shape is substantially conformal to that of the conductors 220*a* as a whole.

It will be further recognized that the substantially planar configuration of the carrier 280 lends itself to being received within corresponding recesses or apertures (not shown) formed within the housing element 202. For example, a recess or aperture may be formed in the housing and shaped to receive the carrier 280 when the latter is clipped onto the first conductors 220*a*, thereby adding additional rigidity.

Lastly, it will be recognized that while the embodiment of FIGS. 2*a*–2*c* are so-called "latch-up/down" variants, with the modular plug latch for the top row of connectors disposed at the top of the connector housing 202, and latch for the bottom row of connectors at the bottom of the housing 202, thereby avoiding mutual interference of the latches when the user attempts to operate them, the invention may alternatively be embodied with other configurations, such as (i) both latches "down"; (ii) both latches up, or (iii)a "latch-down/up" configuration. The modifications to the embodiments previously shown herein to effect such alternate configurations are within the skill of the ordinary artisan, and accordingly are not described further herein.

Connector Assembly with Light Sources

Figure 3B:
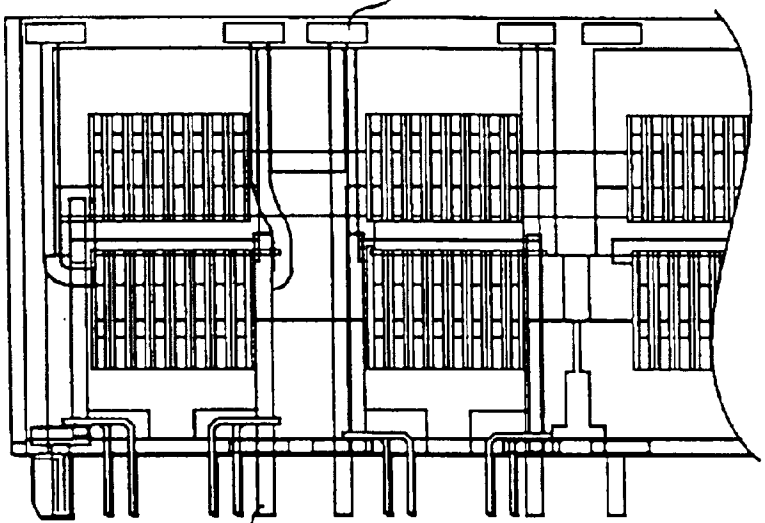
FIG. 3*b* is a rear plan view of a multi-port, two row connector assembly according to the present invention including a variety of alternate configurations of light source conductor routing.
Figure 3A:
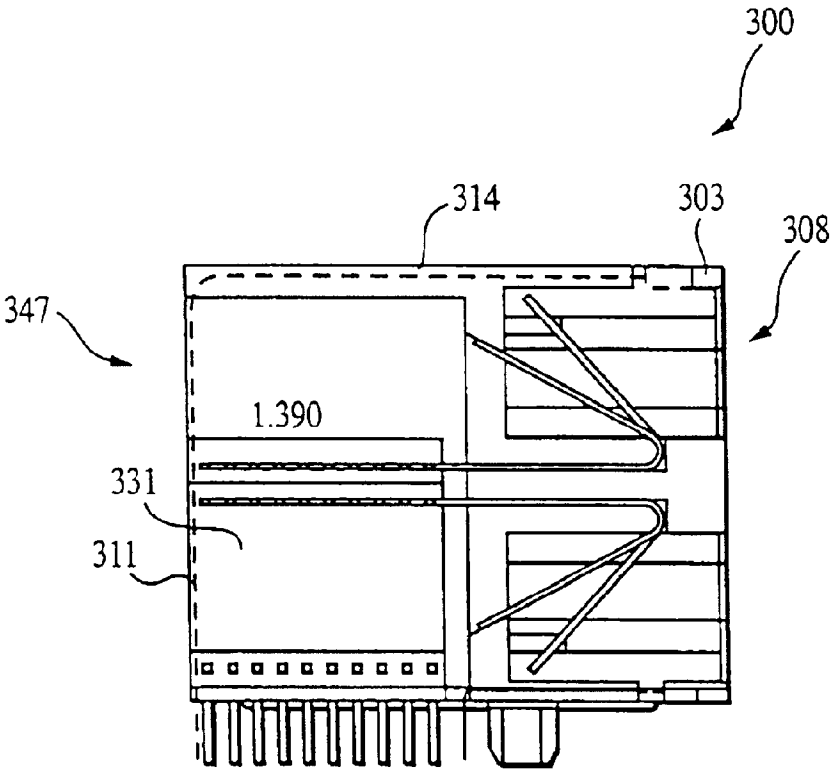
FIG. 3*a* is a side cross-sectional view of a third exemplary embodiment (including light sources) of the connector assembly according to the present invention.
Figure 3C:
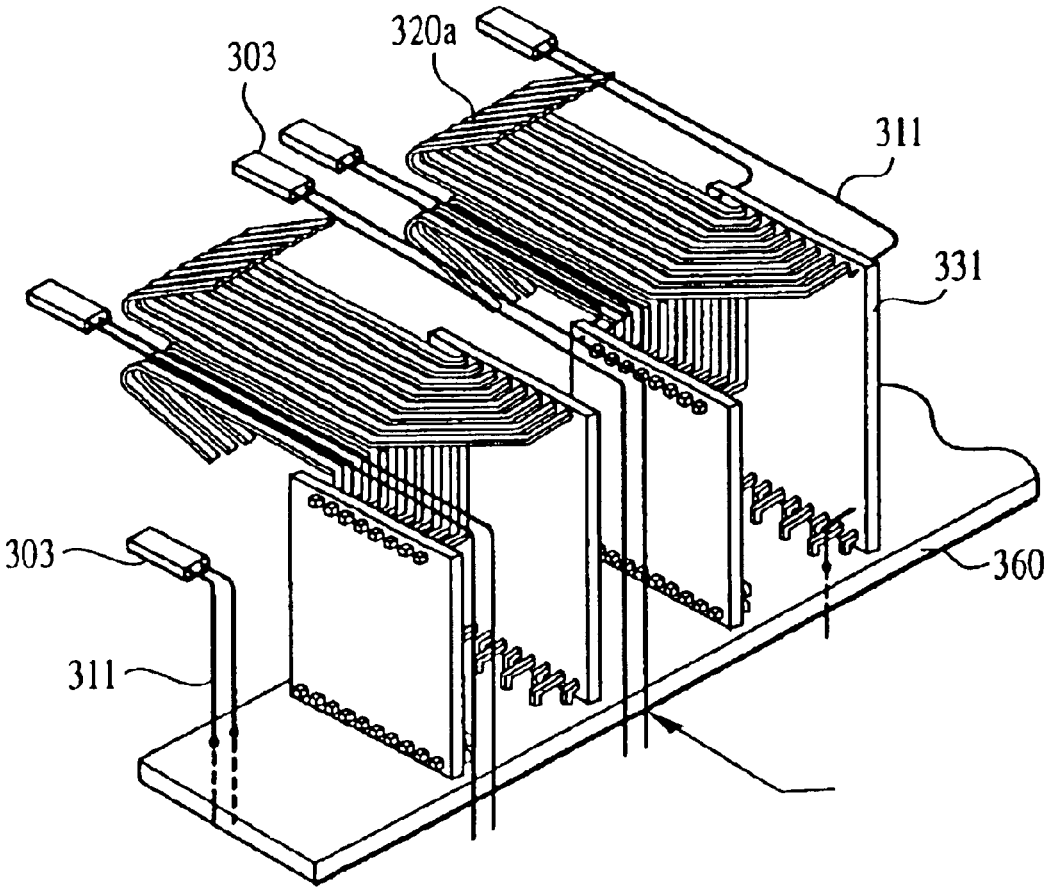
FIG. 3*c* is a rear perspective view of the primary substrate assemblies with light sources (less other electronic components and/or conductive traces) used in the embodiments of FIGS. 3*a* and 3*b*.

Referring now to FIGS. 3*a*–3*c*, yet another embodiment of the connector assembly of the present invention is described. As shown in FIGS. 3*a*–3*c*, the connector assembly 300 further comprises a plurality of light sources 303, presently in the form of light emitting diodes LEDs of the type well known in the art. The light sources 303 are used to indicate the status of the electrical connection within each connector, as is well understood. The LEDs 303 of the embodiment of FIGS. 3*a*–3*c* are disposed at the bottom edge 309 of the bottom row 310 and the top edge 314 of the top row 308, two LEDs per connector adjacent to and on either side of the modular plug latch mechanism 350, so as to be visible from the front face of the connector assembly 300. The individual LEDs 303 are, in the present embodiment, received within recesses 344 formed in the front face of the housing element 302. The LEDs each include two conductors 311 which run from the rear of the LED to the rear portion of the connector housing element 302 generally in a horizontal direction within lead channels 347 formed in the housing element 302. The LED conductors 311 are sized and deformed at such an angle towards their distal ends 317 such that they can either (i) mate with respective apertures formed on the primary substrate(s) associated with each modular plug port, the conductors then being in electrical communication with respective second conductors disposed at the other end of the primary substrate, (ii) run uninterrupted to the secondary substrate (i.e., one continuous conductor), and penetrate therethrough and emerge from corresponding apertures 319 formed in the secondary substrate 360, generally parallel to the second conductors 220*b* held within the lower end of the primary substrate, or (iii) run directly from the LED to the PCB/external device without regard to or interaction with the secondary substrate. These three alternatives are illustrates in FIGS. 3*b* and 3*c*. It will be recognized that while FIGS. 3*b* and 3*c* show various alternatives for LED conductor routing, only one option will be used in any given connector assembly, although it is feasible to mix the various approaches within one device. The LED conductors 311 may also optionally be frictionally received in complementary horizontal or vertical grooves 397 formed in the connector housing, such that the LED conductors are more positively registered with respect to the second conductors 220*b*, thereby facilitating insertion through the secondary substrate and/or PCB/external device.

Similarly, a set of complementary grooves (not shown) may be formed if desired, such grooves terminating on the bottom face of the housing 302 coincident with the conductors 311 for the LEDs of the bottom row of connectors. These allow the LED conductors to be received within their respective recesses 344, and upon emergence from the rear end of the recess 344, be deformed downward to be frictionally received within their respective grooves.

The recesses 344 formed within the housing element 302 each encompass their respective LED when the latter is inserted therein, and securely hold the LED in place via friction between the LED 303 and the inner walls of the recess (not shown). Alternatively, a looser fit and adhesive may be used, or both friction and adhesive.

Figure 3D:
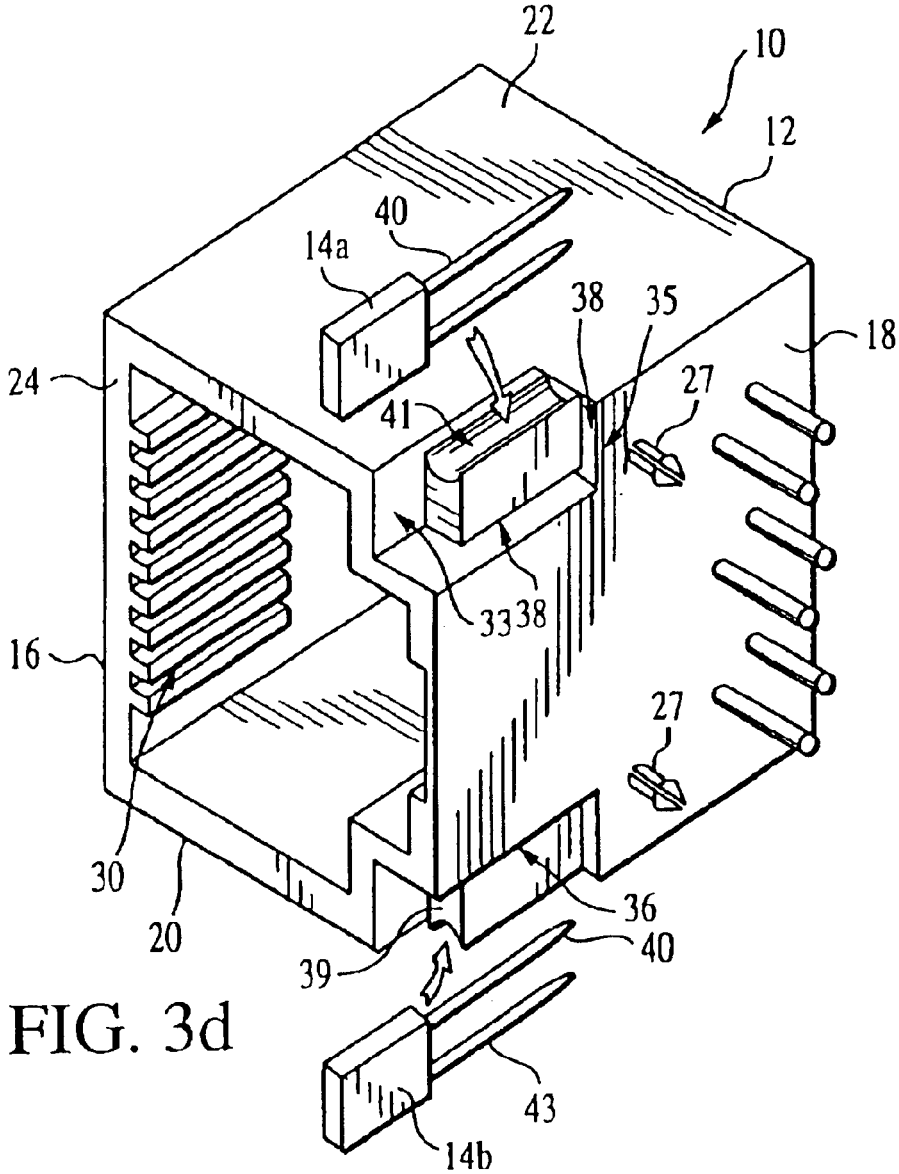
FIGS. 3*d*–*e* illustrate another embodiment of the light source mounting which may be used consistent with the invention.
Figure 3E:
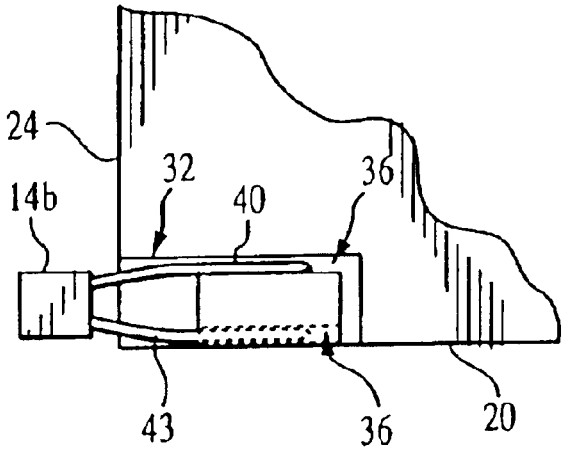

As yet another alternative, the recess 344 may comprise only two walls, with the LEDs being retained in place primarily by their conductors 311, which are frictionally received within grooves formed in the adjacent surfaces of the connector housing. This latter arrangement is illustrated most clearly in U.S. Pat. No. 6,325,664 entitled "Shielded Microelectronic Connector with Indicators and Method of Manufacturing" issued Dec. 4, 2001, and assigned to the Assignee hereof, which is incorporated by reference herein in its entirety. FIGS. 3*d* and 3*e* show an exemplary embodiment of a single port connector composed of, inter alia, a connector body 12 and indicating devices 14*a–b*. The body 12 of the present embodiment further includes two channels 32, 33 formed generally on the bottom corners 34, 35 of the body 12. The channels 32, 33 are configured to receive indicating devices 14*a–b*. In one embodiment, the indicating devices 14*a–b* are light emitting diodes (LEDs) having a generally rectangular box-like shape. Two pairs of lead grooves 36, 38 and a land 39 are formed on the exterior of the bottom wall 18. The grooves 36, 38 are in communication with their respective channels 32, 33 and are of a size so as to frictionally receive the leads 40 of the LEDs 14. The frictional fit of the leads 40 in the grooves 36, 38 permits the LEDs to be retained within their respective channels without the need for other retaining devices or adhesives. It will be appreciated, however, that such additional retaining devices or adhesives may be desirable to add additional mechanical stability to the LEDs when installed or to replace the grooves altogether. Additionally, the lead 40 which lies in the groove 36 can be heat staked. The outer edge of each land 39 further optionally includes a recess 41 for retaining the outer LED lead 43 if a noise shield is installed around the connector body 12. The aforementioned location of the channels 32, 33, grooves 36, 38, and lands 39 allows the leads 40 of the LEDs to be deformed downward at any desired angle or orientation such that they may be readily and directly mated with the circuit board 50 or other devices (not shown) while minimizing total lead length. Reduced lead length is desirable from both cost and radiated noise perspectives. The placement of the LEDs in the grooves 36, 38 and channels 32, 33 further permits the outer profile of the connector to be minimized, thereby economizing on space within the interior of any parent device in which the connector 10 is used.

It will be noted that while channels 32, 33, grooves 36, 38, and lands 39 are described above, other types of forms and/or retaining devices, as well as locations therefore, may be used with the present invention. For example, the aforementioned indicating devices 14 can be mounted on the bottom surface of the connector using only adhesive and the grooves 36, 38 to retain the leads 40 and align the devices 14. Alternatively, the channels and grooves can be placed laterally across the bottom surface of the connector body 12 such that the indicating devices 14 are visible primarily from the side of the connector, or from the top of the connector. Many such permutations are possible and considered to be within the scope of the invention described herein.

As yet another alternative, the external shield element 272 may be used to provide support and retention of the LEDs within the recesses 344, the latter comprising three-sided channels into which the LEDs 303 fit. Many other configurations for locating and retaining the LEDs in position with respect to the housing element 302 may be used, such configurations being well known in the relevant art.

The two LEDs 303 used for each connector 304 radiate visible light of the desired wavelength(s), such as green light from one LED and red light from the other, although multi-chromatic devices (such as a "white light" LED), or even other types of light sources, may be substituted if desired. For example, a light pipe arrangement such as that using an optical fiber or pipe to transmit light from a remote source to the front face of the connector assembly 300 may be employed. Many other alternatives such as incandescent lights or even liquid crystal (LCD) or thin film transistor (TFT) devices are possible, all being well known in the electronic arts.

The connector assembly 300 with LEDs 303 may further be configured to include noise shielding for the individual LEDs if desired. Note that in the embodiment of FIGS. 3*a–3c*, the LEDs 303 are positioned inside of (i.e., on the connector housing side) of the external noise shield 272. If it is desired to shield the individual connectors 304 and their associated conductors and component packages from noise radiated by the LEDs, such shielding may be included within the connector assembly 300 in any number of different ways. In one embodiment, the LED shielding is accomplished by forming a thin metallic (e.g., copper, nickel, or copper-zinc alloy) layer on the interior walls of the LED recesses 344 (or even over the non-conductive portions of LED itself) prior to insertion of each LED. In a second embodiment, a discrete shield element (not shown) which is separable from the connector housing 302 can be used, each shield element being formed so as to accommodate it's respective LED and also fit within its respective recess 344. In yet another embodiment, the external noise shield 272 may be fabricated and deformed within the recesses 344 so as to accommodate the LEDs 303 on the outer surface of the shield, thereby providing noise separation between the LEDs and the individual connectors 304. This latter approach is also described in detail in U.S. Pat. No. 6,325,664 entitled "Shielded Microelectronic Connector with Indicators and Method of Manufacturing" previously incorporated herein. Myriad other approaches for shielding the connectors 304 from the LEDs may be used as well if desired, with the only constraint being sufficient electrical separation between the LED conductors and other metallic components on the connector assembly to avoid electrical shorting.

FIG. 4 illustrates yet another embodiment of the connector assembly of the invention, wherein the light sources comprises a light pipe arrangement. Light pipes are generally known in the art; however, the arrangement of the present invention adapts the light pipe to the connector configurations otherwise disclosed herein. Specifically, as shown in FIG. 4, the illustrated embodiment comprises a two-row connector assembly (i.e., at least one upper row connector and at least one lower row connector) having one or more light pipe assemblies 410 associated therewith. For the upper row connector 402, the light pipe assembly 410*a* comprises an optically conductive medium 404 adapted to transmit the desired wavelength(s) of light energy from a light source 412, in this case an LED. The LED 412 is disposed on the substrate to which the connector assembly is mounted, e.g., a PCB or other device. The LED 412 fits within a recess 414 formed within the bottom surface of the connector assembly which is adapted and sized to receive the LED. The recess 414 may also be coated internally with a reflective coating of the type well known in the art to enhance the reflection of light energy radiated by the LED during operation into the interior face 416 of the optical medium 404. The optically conductive medium may comprise a single unitary light path from the interior face 416 to the viewing face 418, or alternatively a plurality of abutted or joined optically transmissive segments. As yet another approach, one or more "ganged" optical fibers (e.g., single mode or multi-mode fibers of the type well known in the optical networking arts) may be used as the optical medium. As yet another alternative, a substantially prismatic device may be used as the optical medium 404, especially if substantial chromatic dispersion is desired. The optical medium may be removably retained within the connector assembly housing 406, or alternatively fixed in place (such as by being molded within the housing, or retained using an adhesive or fiction), or any combination of the foregoing as desired.

Similarly, while the light sources 412 of the embodiment of FIG. 4 are disposed on the PCB or other device to which the connector assembly is mounted, it will be recognized that the light sources may be retained either fixedly or removably within the connector housing, such that the light sources are installed on the PCB/parent device simultaneously with the connector.

The second light pipe assembly 410*b* is disposed within the upper portion of the connector housing within a channel formed therein. It will be noted that due to the longer optical "run" and greater optical losses associated with this second optical medium 405, the size/intensity of the LED 413, and/or the optical properties or dimensions of the medium 405, may optionally be adjusted so as to produce a luminosity substantially equivalent to that associated with the first light pipe assembly 410*a* if desired.

As shown in FIG. 4, the viewing faces 418 of the respective light pipe assemblies 410*a*, 410*b* are disposed at the bottom and top portions of the front face 425 of the connector housing 406, generally adjacent to the latching mechanism 430 for the modular plug (not shown). It will be recognized, however, that all or portions of the light pipe assemblies may be disposed in other locations in the connector assembly 400. For example, if desired, the optical media may be routed such that the viewing faces 418 associated with each light pipe are disposed centrally in the housing; i.e., generally at the intersection 432 of the bottom and top row connectors, regardless of whether a "latch apart" arrangement (i.e., latches disposed generally at opposite faces of the connector housing) such as that of FIG. 4 is used or not.

Similarly, it will be recognized that the placement of the light sources within the connector housing 406 may be varied. For example, the LEDs could be placed in a more central location on the bottom face 440 of the connector (not shown), in tandem or front-back arrangement, with the respective optical media being routed to the desired viewing face location. As yet another alternative, the top (rear) light sources could be placed remote from the PCB/parent device, such that it is disposed within the top rear wall area 442 of the connector housing, thereby allowing the use of a "straight run" of optical medium (not shown).

It can also be appreciated that while the foregoing embodiment is described in terms of a two-row connector device, the light pipe assemblies of the invention may also be implemented in devices having greater or lesser numbers of rows.

Figure 5:
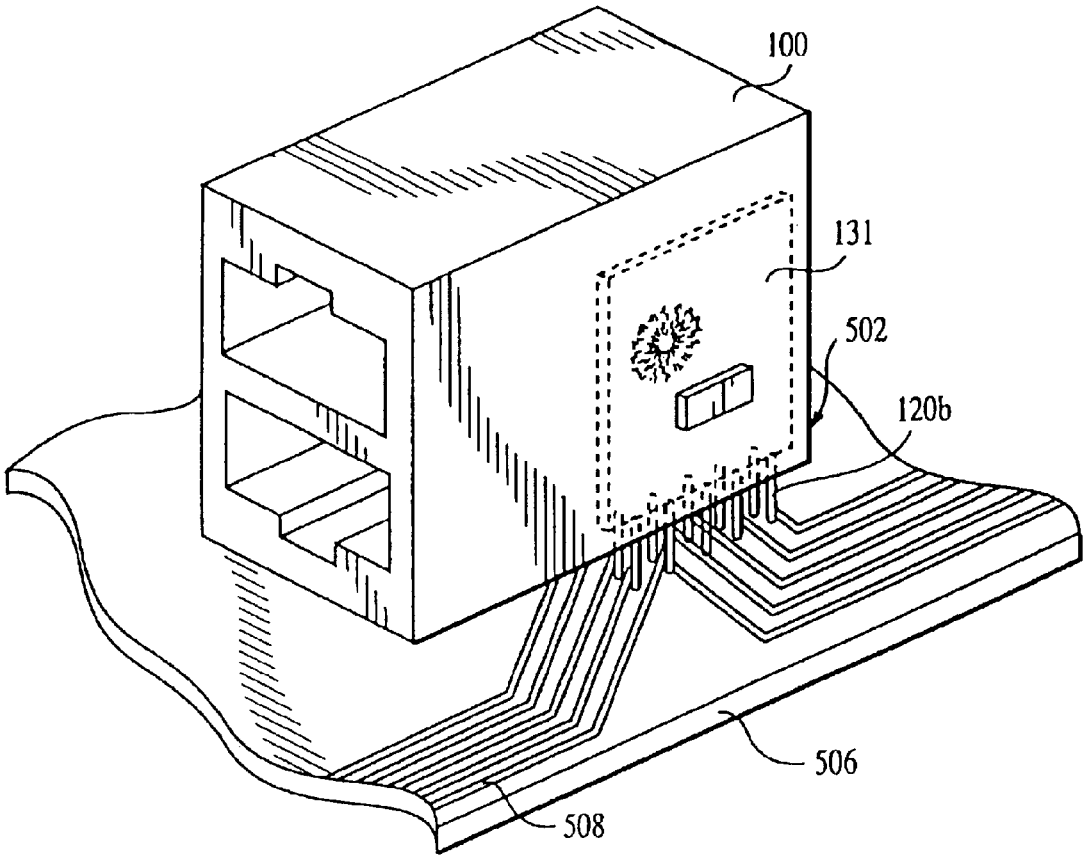
FIG. 5 is a perspective view of the connector of FIGS. 1*a*–1*c* mounted on a typical printed circuit board device.

FIG. 5 illustrates the connector assembly of FIGS. 1*a*–1*c* mounted to an external substrate, in this case a PCB. As shown in FIG. 5, the connector assembly 100 is mounted such that the lower conductors 120 penetrate through respective apertures 502 formed in the PCB 506. The lower conductors are soldered to the conductive traces 508 immediately surrounding the apertures 502, thereby forming a permanent electrical contact there between. Note that while a conductor/aperture approach is shown in FIG. 5, other mounting techniques and configurations may be used. For example, the lower conductors 120 may be formed in such a configuration so as to permit surface mounting of the connector assembly 100 to the PCB 506, thereby obviating the need for apertures 502. As another alternative, the connector assembly 100 may be mounted to an intermediary substrate (not shown), the intermediary substrate being mounted to the PCB 506 via a surface mount terminal array such as a ball grid array (BGA), pin grid array (PGA), or other non-surface mount technique. The footprint of the terminal array is reduced with respect to that of the connector assembly 100, and the vertical spacing between the PCB 506 and the intermediary substrate adjusted such that other components may be mounted to the PCB 506 outside of the footprint of the intermediary substrate terminal array but within the footprint of the connector assembly 100.

It will be further noted that each of the foregoing embodiments of the connector assembly of the invention may be outfitted with one or more internal noise/EMI shields in order to provide enhanced electrical separation and reduced noise between conductors and electronic components. For example, the shielding arrangement(s) described in applicants co-pending U.S. patent application Ser. No. 09/732,098 entitled "Shielded Microelectronic Connector Assembly and Method of Manufacturing", filed Dec. 6, 2000, and assigned to the Assignee hereof, incorporated by reference herein in its entirety, may be used, whether alone or in conjunction with other such shielding methods.

Figure 5A:
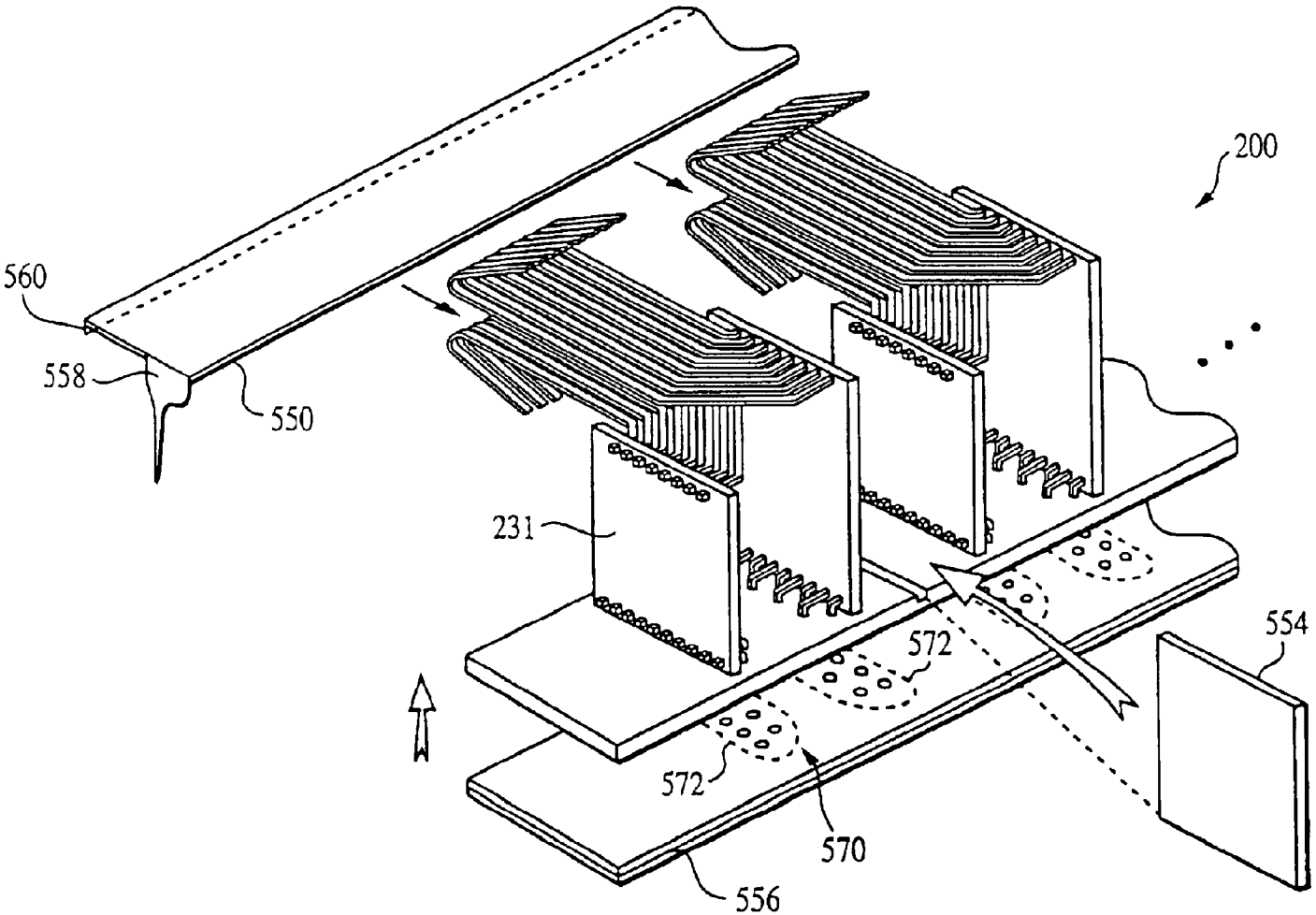
FIG. 5*a* is a rear perspective view of another embodiment of the connector assembly of the present invention, including optional noise shield elements.

FIG. 5*a* illustrates one such exemplary embodiment of a shielded connector assembly, wherein a "top-to-bottom" shield element 550 disposed between the first conductors of the upper and lower connector ports of each port pair is used. Additionally, transverse shield elements 554 (i.e., having a substantially similar orientation as the substrates) may be used, both (i) between the substrates 231 of a given port pair to help mitigate cross-talk and EMI between the components on the two substrates; and (ii) between adjacent substrates of two contiguous port pairs, thereby mitigating "cross-port pair" cross-talk and radiated EMI. Furthermore, a substrate shield 556 such as that shown in FIG. 5*a*, can be used with the connector assembly, thereby mitigating noise primarily in directions normal to the parent PCB or device to which the connector assembly is mounted.

It is noted that the terms "top-to-bottom" and "transverse" as used herein are also meant to include orientations which are not purely horizontal or vertical, respectively, with reference to the plane of the connector assembly. For example, one embodiment of the connector assembly of the invention (not shown) may comprise a plurality of individual connectors arranged in an array which is curved or non-linear with reference to a planar surface, such that the top-to-bottom noise shield would also be curved or non-linear to provide shielding between successive rows of connectors. Similarly, the transverse shield elements could be disposed in an orientation which is angled with respect to the vertical. Hence, the foregoing terms are in no way limiting of the orientations and/or shapes which the disclosed shield elements 550, 554, 556 may take.

Similarly, while such shield elements are described herein in terms of a single, unitary component, it will be appreciated that the shield elements may comprise two or more sub-components that may be physically separable from each other. Hence, the present invention anticipates the use of "multi-part" shields.

The top-to-bottom shield element 550 in the illustrated embodiment (FIG. 5*a*) is formed from a copper zinc alloy (260), temper H04, which is approximately 0.008 in. thick and plated with a bright 93%/7% tin-lead alloy (approximately 0.00008–0.00015 inch thick) over a matte nickel underplate (approximately 0.00005–0.00012 inch thick). However, other materials, constructions, and thickness values may be substituted depending on the particular application. The shield element 305 further includes two joints 558 disposed at either end of the element 550, which cooperate with two lateral slots in the external shield (not shown) to couple the top-to-bottom shield element 550 to the external shield after the connector assembly has been fully assembled. The joints 558 are optionally soldered or otherwise in contact with the edges of the lateral slots in the external shield, thereby forming an electrically conductive path if desired. The shield element (or portions thereof) may also optionally be provided with a dielectric overcoat, such as a layer of Kapton™ polyimide tape.

The top-to-bottom shield element 550 is in one embodiment received within a groove or slot (not shown) formed in the front face of the connector housing element 202 to a depth such that shielding between the top row of first conductors 220*a* and bottom row of first conductors is accomplished. In the illustrated embodiment, the shield element 550 includes a retainer tab 560 which is formed by bending the outward edge of the shield element 550 at an angle with respect to the plane of the shield element 550 at the desired location. This arrangement allows the shield element 550 to be inserted within the slot to a predetermined depth, thereby reducing the potential for variation in the depth to which the shield element penetrates from assembly to assembly during manufacturing. It will be recognized, however, that other arrangements for positioning the top-to-bottom shield element 550 may be utilized, such as pins, detents, adhesives, etc., all of which are well known in the art.

The connector assembly 200 of the FIG. 5*a* comprises a shield substrate 556 which is disposed in the illustrated embodiment on the bottom face of the connector assembly 200 adjacent to the PCB or substrate to which the assembly 200 is ultimately mounted. The shield substrate comprises, in the illustrated embodiment, at least one layer of fiberglass upon which a layer of tin-plated copper or other metallic shielding material is disposed. The exposed portions of both the fiberglass and metallic shield may also be optionally coated with a polymer for added stability and dielectric strength. The substrate 556 further includes a plurality of terminal pin perforation arrays 570 formed at predetermined locations on the substrate 556 with respect to the lower conductors 220*b* of each primary substrate 231 such that when the connector assembly 200 is fully assembled, the lower conductors 220*b* penetrate the substrate 556 via respective ones of the terminal pin arrays 570. Provision for a pin or other element (not shown) connecting the metallic shield to the external noise shield (if so equipped) is also provided. In this manner, the shield elements are electrically coupled and ultimately grounded so as to avoid accumulation of electrostatic potential or other potentially deleterious effects.

In the illustrated embodiment, the metallic shield layer 556 is etched or removed from the area 572 immediately adjacent and surrounding the terminal pin arrays 570, thereby removing any potential for undesirable electrical shorting or conductance in that area. Hence, the lower conductors 220*b* of each connector penetrate the substrate and only contact the non-conductive fiberglass layer of the substrate 556, the latter advantageously providing mechanical support and positional registration for the lower conductors 220*b*. It will be recognized that other constructions of the substrate shield 556 may be used, however, such as two layers of fiberglass with the metallic shield layer "sandwiched" between, or even other approaches.

The metallic shield layer of the substrate 556 acts to shield the bottom face of the connector assembly 200 against electronic noise transmission. This obviates the need for an external metallic shield encompassing this portion of the connector assembly 200, which can be very difficult to execute from a practical standpoint since the conductors 220*b* occupy this region as well. Rather, the substrate 556 of the present invention provides shielding of the bottom portion of the connector assembly 200 with no risk of shorting from the lower conductors 220*b* to an external shield, while also providing mechanical stability and registration for the lower conductors 220*b*.

In an alternate embodiment, the shielded substrate 556 may comprise a single layer of metallic shielding material (such as copper alloy; approximately 0.005 in. thick), which has been formed to cover substantially all of the bottom surface of the connector assembly. As with the shield substrate previously described, the portion of the single metallic layer immediately adjacent the lower conductors 220*b* has been removed to eliminate the possibility of electrical shorting to the shield. The shield of this alternative embodiment is also soldered or otherwise conductively joined to the external noise shield (if provided) to provide grounding for the former. This alternative embodiment has the advantage of simplicity of construction and lower manufacturing cost, since the fabrication of the single layer metallic is much simpler than its multilayer counterpart of the embodiment shown in FIG. 5*a*.

Method of Manufacture

Figure 6:
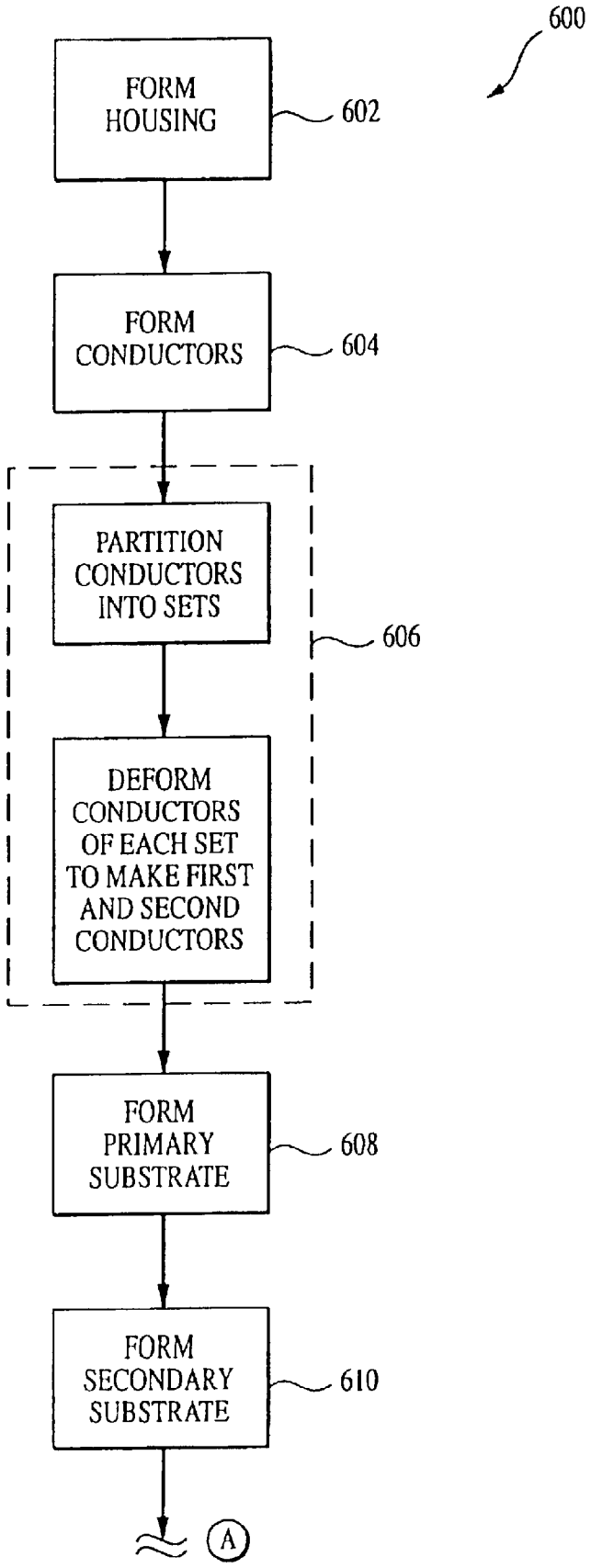
FIG. 6 is a logical flow diagram illustrating one exemplary embodiment of the method of manufacturing the connector assembly of the present invention.
Figure 6:
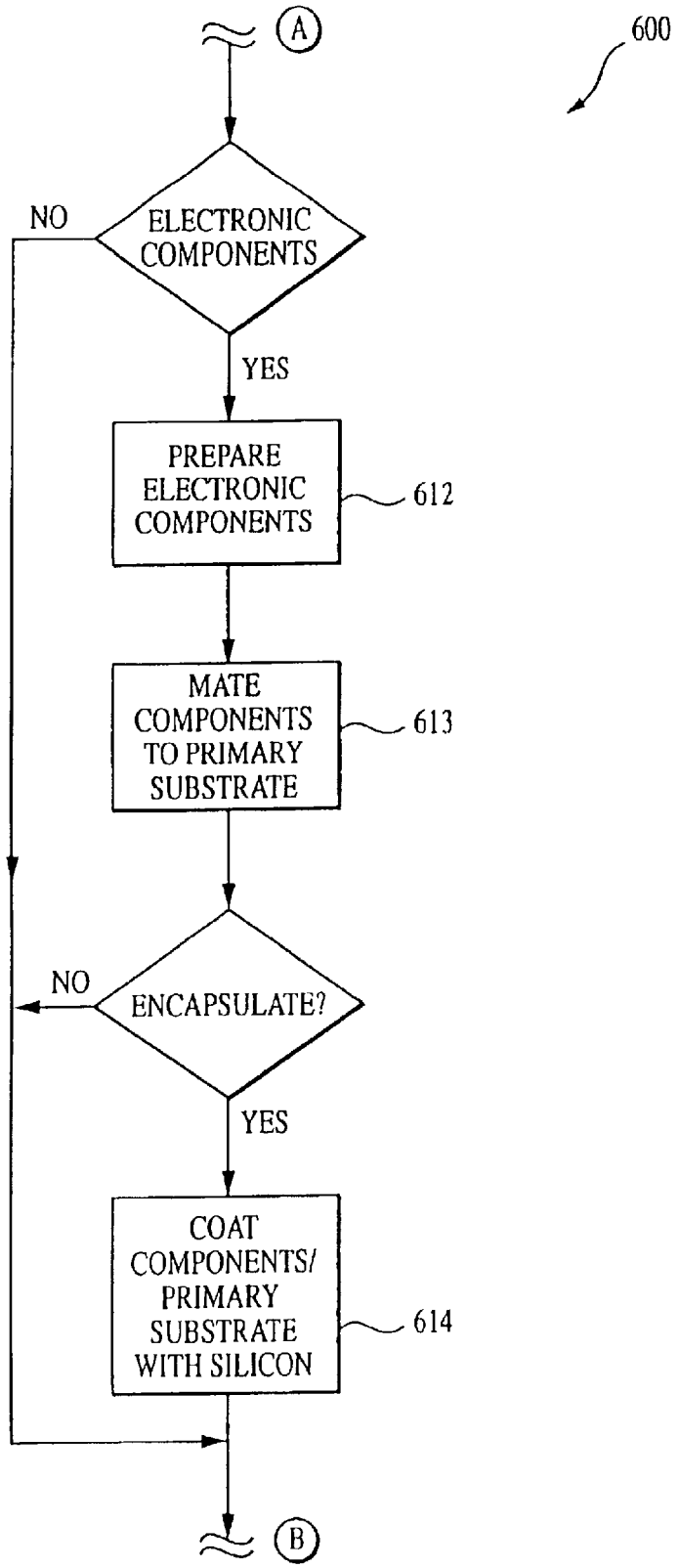
Figure 6:
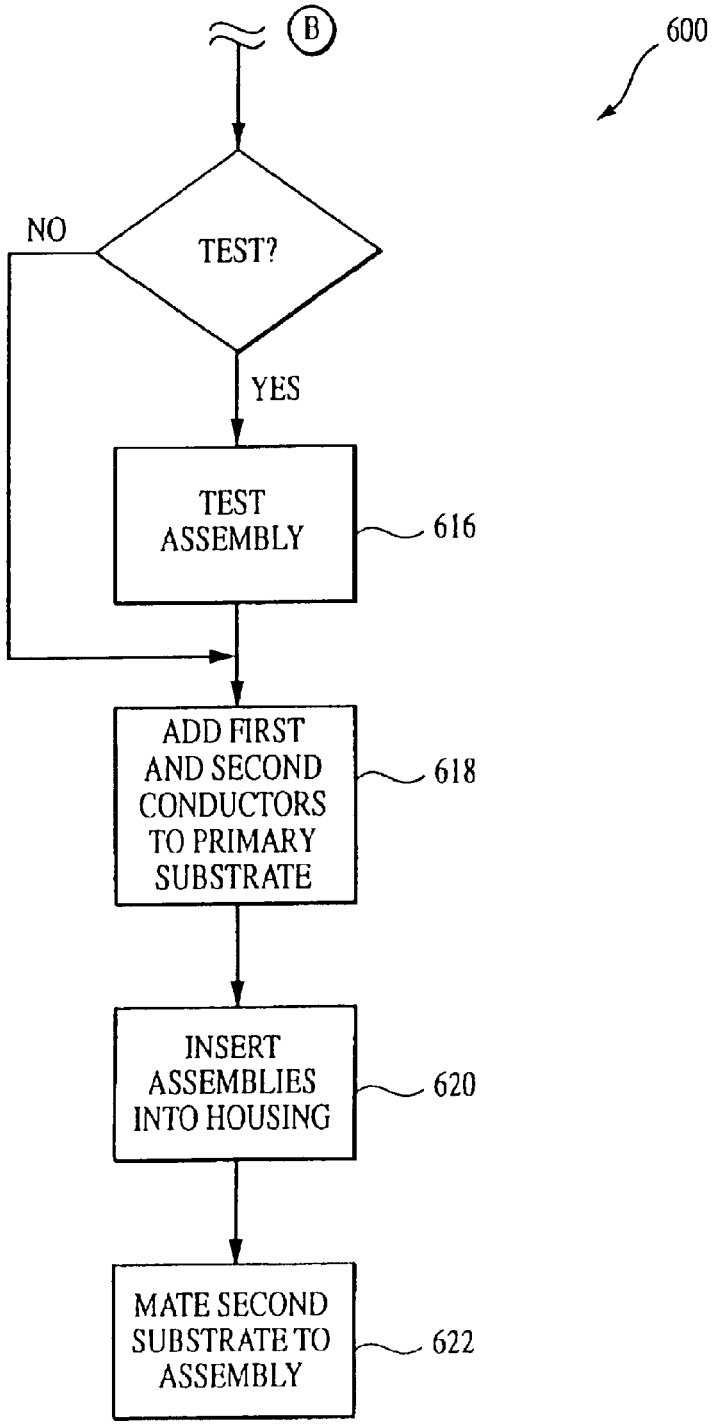

Referring now to FIG. 6, the method 600 of manufacturing the aforementioned connector assembly 100 is described in detail. It is noted that while the following description of the method 600 of FIG. 6 is cast in terms of the single port pair connector assembly, the broader method of the invention is equally applicable to other configurations (e.g., the "row-and-column" embodiment of FIG. 2).

In the embodiment of FIG. 6, the method 600 generally comprises first forming the assembly housing element 102 in step 602. The housing is formed using an injection molding process of the type well known in the art, although other processes may be used. The injection molding process is chosen for its ability to accurately replicate small details of the mold, low cost, and ease of processing.

Next, two conductor sets are provided in step 604. As previously described, the conductor sets comprise metallic (e.g., copper or aluminum alloy) strips having a substantially square or rectangular cross-section and sized to fit within the slots of the connectors in the housing 102.

In step 606, the conductors are partitioned into sets; a first set 120*a* for use with the connector recess (i.e., within the housing 102, and mating with the modular plug terminals), and a second set 120*b* for mating with the PCB or other external device to which the connector assembly is mated. The conductors are formed to the desired shape(s) using a forming die or machine of the type well known in the art. Specifically, for the embodiment of FIG. 1, the first conductor set 120*a* is deformed so as to produce the juxtaposed, coplanar "90-degree turn", as previously described. The second conductor 120*b* set is deformed to produce the desired juxtaposed, non-coplanar array which is used to mate with the PCB/external device.

Note also that either or both of the aforementioned conductor sets may also be notched (not shown) at their distal ends such that electrical leads associated with the electronic components (e.g., fine-gauge wire wrapped around the magnetic toroid element) may be wrapped around the distal end notch to provide a secure electrical connection.

Next, the primary substrate is formed and perforated through its thickness with a number of apertures of predetermined size in step 608. Methods for forming substrates are well known in the electronic arts, and accordingly are not described further herein. Any conductive traces on the substrate required by the particular design are also added, such that necessary ones of the conductors, when received within the apertures, are in electrical communication with the traces.

The apertures within the primary substrate are arranged in two arrays of juxtaposed perforations, one at each end of the substrate, and with spacing (i.e., pitch) such that their position corresponds to the desired pattern, although other arrangements may be used. Any number of different methods of perforating the substrate may be used, including a rotating drill bit, punch, heated probe, or even laser energy. Alternatively, the apertures may be formed at the time of formation of the substrate itself, thereby obviating a separate manufacturing step.

Next, the secondary substrate formed and is perforated through its thickness with a number of apertures of predetermined size in step 610. The apertures are arranged in an array of bi-planar perforations which receive corresponding ones of the second conductors 120*b* therein, the apertures of the second substrate acting to register and add mechanical stability to the second set of conductors. Alternatively, the apertures may be formed at the time of formation of the substrate itself.

In step 612, one or more electronic components, such as the aforementioned toroidal coils and surface mount devices, are next formed and prepared (if used in the design). The manufacture and preparation of such electronic components is well known in the art, and accordingly is not described further herein. The electronic components are then mated to the primary substrate in step 613. Note that if no components are used, the conductive traces formed on/within the primary substrate will form the conductive pathway between the first set of conductors and respective ones of the second set of conductors. The components may optionally be (i) received within corresponding apertures designed to receive portions of the component (e.g., for mechanical stability), (ii) bonded to the substrate such as through the use of an adhesive or encapsulant, (iii) mounted in "free space" (i.e., held in place through tension generated on the electrical leads of the component when the latter are terminated to the substrate conductive traces and/or conductor distal ends, or (iv) maintained in position by other means. In one embodiment, the surface mount components are first positioned on the primary substrate, and the magnetics (e.g., toroids) positioned thereafter, although other sequences may be used. The components are electrically coupled to the PCB using a eutectic solder re-flow process as is well known in the art. The assembled primary substrate with electronic components is then optionally secured with a silicon encapsulant (step 614), although other materials may be used.

In step 616, the assembled primary substrate with SMT/magnetics is electrically tested to ensure proper operation.

The first and second sets of conductors are next disposed within respective ones of the apertures in the primary substrate such that two arrays of conductors, each terminated generally to one end of the substrate, are formed (step 618). As previously described, the first set of conductors 120*a* forms a co-planar juxtaposed array for mating with the terminals of the modular plug, while the second set of conductors forms a juxtaposed, bi-planar terminal array which is received within, for example, the PCB to which the assembly is ultimately mated. The conductor ends are sunk within the apertures to the desired depth within the primary substrate, and optionally bonded thereto (such as by using eutectic solder bonded to the conductor and surrounding substrate terminal pad, or adhesive) in addition to being frictionally received within their respective apertures, the latter being slightly undersized so as to create the aforementioned frictional relationship. As yet another alternative, the distal ends of the conductors may be tapered such that a progressive frictional fit occurs, the taper adjusted to allow the conductor penetration within the board to the extent (e.g., depth) desired.

As yet another alternative to the foregoing, the conductors of each set may be "molded" within the primary substrate at the desired location at the time of formation of the latter. This approach has the advantage of obviating subsequent steps of insertion/bonding of the conductors, but also somewhat complicates the substrate manufacturing process.

The finished insert assembly is then inserted into the housing element 102 in step 620, such that the assembly is received into the cavity 134, and the first conductors received into respective ones of the grooves 122 formed in the assembly housing 102.

Next, in step 622, the secondary substrate is mated to the primary substrate such that the second set of conductors protrude through the bi-planar aperture array, the former ultimately being terminated to the target PCB/external device. The secondary substrate may by simply fitted onto the second set of conductors and held in place by friction between the two components, or alternatively physically bonded to the primary substrate and/or second conductors if desired, such as using eutectic solder. Other means of positioning/engagement may also be used, such as attachment of the secondary substrate to the walls of the housing element alone. This step 622 completes the formation of the connector assembly.

With respect to the other embodiments described herein (i.e., multi-port "row and column" connector housing, connector assembly with LEDs, etc.), the foregoing method may be modified as necessary to accommodate the additional components. For example, where a multi-port connector is used, a single common secondary substrate may be fabricated, and the second conductors of the respective primary electronic component assemblies inserted into the common secondary substrate to produce a single assembly for the connector as a whole. Such modifications and alterations will be readily apparent to those of ordinary skill, given the disclosure provided herein.

It will be recognized that while certain aspects of the invention are described in terms of a specific sequence of steps of a method, these descriptions are only illustrative of the broader methods of the invention, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the invention disclosed and claimed herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. A connector assembly comprising:

a connector housing comprising a connector having:

a recess adapted to receive at least a portion of a modular plug, said modular plug having a plurality of terminals disposed thereon;

at least one substrate having at least one electrically conductive pathway associated therewith;

a cavity adapted to receive at least a portion of said at least one substrate;

a plurality of first conductors disposed at least partly within said recess, said first conductors being configured to form an electrical contact with respective ones of said terminals when said modular plug is received within said recess, and form an electrical pathway between said first conductors and said at least one substrate; and a plurality of second conductors, at least one of said second conductors being in electrical communication with said at least one electrically conductive pathway of said at least one substrate;

wherein at least a portion of said first conductors are substantially coplanar and each include an effectively curved portion, the effective radius of each said effectively curved portion being different for each of said first conductors.

2. The connector assembly of claim 1, wherein said effectively curved portions each comprises a substantially continuous bend radius.

3. The connector assembly of claim 1, wherein said effectively curved portion of said first conductors comprises a plurality of bend segments.

4. The connector assembly of claim 1, further comprising at least one electrical component disposed on said at least one substrate, wherein said at least one electrical component has an elevation below that of said first conductors.

5. The connector assembly of claim 1, further comprising at least one conductor carrier, said carrier being adapted to retain said first conductors in a predetermined orientation.

6. A connector assembly comprising:

a connector housing comprising a connector having:

a recess adapted to receive at least a portion of a modular plug, said modular plug having a plurality of terminals disposed thereon;

at least one substrate having at least one electrically conductive pathway associated therewith;

a cavity adapted to receive at least a portion of said at least one substrate;

a plurality of first conductors disposed at least partly within said recess, said first conductors being configured to form an electrical contact with respective ones of said terminals when said modular plug is received within said recess, and form an electrical pathway between said first conductors and said at least one substrate; and a plurality of second conductors, at least one of said second conductors being in electrical communication with said at least one electrically conductive pathway of said at least one substrate;

wherein said at least one substrate is disposed in substantially vertical orientation within, and substantially orthogonal to the front face of, said housing.

7. The connector assembly of claim 6, wherein at least a portion of said first conductors are substantially coplanar and each include an effectively curved portion, the effective radius of each said effectively curved portion being different for each of said first conductors.

8. The connector assembly of claim 6, wherein said first and second conductors mate with said at least one substrate at the top and bottom portions thereof, respectively.

9. A multi-port connector assembly comprising:

a connector housing comprising a plurality of connectors each having:

a recess adapted to receive at least a portion of a modular plug, said modular plug having a plurality of terminals disposed thereon;

at least one substrate having at least one electrically conductive pathway associated therewith, said at least one substrate being disposed in substantially orthogonal orientation with respect to a front face of said housing;

a cavity adapted to receive at least a portion of said at least one substrate;

a plurality of first conductors disposed at least partly within said recess, said first conductors being configured to form an electrical contact with respective ones of said terminals when said modular plug is received within said recess, and form an electrical pathway between said first conductors and said at least one substrate;

a plurality of second conductors, at least one of said second conductors being in electrical communication with said at least one electrically conductive pathway of said at least one substrate; and at least one conductor carrier, said at least one conductor carrier comprising a substantially unitary body having a plurality of grooves formed therein, said grooves further adapted to frictionally receive at least a portion of respective ones of said first conductors therein, said first conductors and said plurality of grooves each including an effectively curved portion, the effective radius of each being different, said at least one carrier also being adapted to retain said first conductors substantially coplanar and separated from one another.

10. A multi-port connector assembly comprising:

a connector housing comprising a plurality of connectors each having:

a recess adapted to receive at least a portion of a modular plug, said modular plug having a plurality of terminals disposed thereon;

at least one substrate having at least one electrically conductive pathway associated therewith, said at least one substrate being disposed in substantially orthogonal orientation with respect to a front face of said housing;

a cavity adapted to receive at least a portion of said at least one substrate;

a plurality of first conductors disposed at least partly within said recess, said first conductors being configured to form an electrical contact with respective ones of said terminals when said modular plug is received within said recess, and form an electrical pathway between said first conductors and said at least one substrate; and a plurality of second conductors, at least one of said second conductors being in electrical communication with said at least one electrically conductive pathway of said at least one substrate;

wherein at least some of said first conductors comprise at least three conductor segments, said at least three segments comprising:

at least a first segment oriented substantially normal to said at least one substrate;

at least a second segment communicating with said at least first segment, said second segment having a substantially different angular orientation with respect to said at least one substrate than said at least first segment; and at least a third segment communicating with said at least second segment, said third segment having a substantially different angular orientation with respect to said at least one substrate than said at least first or second segments.

11. A multi-port connector assembly comprising:

a connector housing comprising a plurality of connectors each having:

a recess adapted to receive at least a portion of a modular plug, said modular plug having a plurality of terminals disposed thereon;

at least one substrate having at least one electrically conductive pathway associated therewith, said at least one substrate being disposed in substantially orthogonal orientation with respect to a front face of said housing;

a cavity adapted to receive at least a portion of said at least one substrate;

a plurality of first conductors disposed at least partly within said recess, said first conductors being configured to form an electrical contact with respective ones of said terminals when said modular plug is received within said recess, and form an electrical pathway between said first conductors and said at least one substrate; and a plurality of second conductors, at least one of said second conductors being in electrical communication with said at least one electrically conductive pathway of said at least one substrate;

wherein at least two of said connectors are disposed in a port pair, said first conductors of a first connector in said port pair being routed over at least a portion of their length to a corresponding one of said at least one substrate in a direction having an angular relationship to the corresponding portion of said first conductors associated with a second connector in said port pair.

12. The connector assembly of claim 11, wherein said at least portion of said first conductors comprises that proximate to said at least one substrate, and said angular relationship comprises routing the first conductors of said first connector in said port pair to mate with said at least one substrate in a direction which is substantially opposite to that of the corresponding portions of said first conductors of said second connector of said port pair.

13. A connector assembly comprising:

a connector housing;

a recess formed in a front surface of said housing and adapted to receive at least a portion of a modular plug, said modular plug having a plurality of terminals disposed thereon;

at least one substrate having at least one electrically conductive pathway associated therewith;

a rear cavity formed within said housing and adapted to receive at least a portion of said at least one substrate;

a plurality of first conductors disposed at least partly within said recess, said first conductors being configured to form an electrical contact with respective ones of said terminals when said modular plug is received within said recess, and form an electrical pathway between said first conductors and said at least one substrate; and a plurality of second conductors, at least one of said second conductors being in electrical communication with said at least one electrically conductive pathway of said at least one substrate;

wherein at least a portion of said first conductors are substantially coplanar and each include an effectively curved portion, the effective radius of each said effectively curved portion being different for each of said first conductors.

14. A connector assembly comprising:

a connector housing;

a recess formed in a front surface of said housing and adapted to receive at least a portion of a modular plug having a plurality of terminals;

at least one substrate having first electrically conductive pathways associated therewith;

a rear cavity formed within said housing and adapted to receive at least a portion of said at least one substrate;

a plurality of first conductors disposed at least partly within said recess, said first conductors being configured to form an electrical contact with respective ones of said terminals, and form second electrically conductive pathways between said first conductors and said at least one substrate;

electronic components dispose din at least some of said first conductive pathways; and a plurality of second conductors, at least one of said second conductors being in electrical communication with respective ones of said first electrically conductive pathways;

wherein at least some of said first conductors have portions which are substantially coplanar with similar portions of other of said first conductors, and include an effectively curved portion, the effective radius of each said effectively curved portions being different for each of said at least some first conductors.

15. A connector assembly comprising:

connector housing means:

a recess formed within said housing means and adapted to receive at least a portion of a modular plug having a plurality of terminals;

at least one means for supporting components having at least one electrically conductive pathway associated therewith;

a cavity formed in said housing means and adapted to receive at least a portion of said at least one means for supporting;

a plurality of first conductor means disposed at least partly within said recess, said first conductor means being configured to form an electrical contact with respective ones of said terminals, and form an electrical pathway between said first conductor means and said at least one means for supporting; and a plurality of second conductor means, at least one of said second conductor means being in electrical communication with said at least one electrically conductive pathway of said at least one means for supporting;

wherein at least some of said first conductor means have an effectively curved portion, the effective radius of each said effectively curved portions being different for each of said first conductor means, said effectively curved portions of each of said at least some conductor means also being substantially coplanar with one another.

16. A multi-port connector assembly comprising:

a connector housing comprising a plurality of connectors each having:

a recess adapted to receive at least a portion of a modular plug, said modular plug having a plurality of terminals disposed thereon;

at least one substrate having at least one electrically conductive pathway associated therewith, said at least one substrate being disposed in substantially orthogonal orientation with respect to a front face of said housing;

a cavity adapted to receive at least a portion of said at least one substrate;

a plurality of first conductors disposed at least partly within said recess, said first conductors being configured to form an electrical contact with respective ones of said terminals when said modular plug is received within said recess, and form an electrical pathway between said first conductors and said at least one substrate;

a plurality of second conductors, at least one of said second conductors being in electrical communication with said at least one electrically conductive pathway of said at least one substrate; and at least one means for holding said first conductors, said means comprising a plurality of restraining means, said restraining means further adapted for receiving at least a portion of respective ones of said first conductors, at least some of said first conductors including an effectively curved portion, the effective radius of each such curved portion being different, said at least one holding means also being adapted to retain said first conductors substantially coplanar and separated from one another.

* * * * *